US009683382B2

(12) United States Patent
Kanetis

(10) Patent No.: US 9,683,382 B2
(45) Date of Patent: Jun. 20, 2017

(54) METHODS AND APPARATUSES FOR A VARIABLE DEPTH SWIMMING POOL/SPA

(75) Inventor: Stefan Kanetis, Del Mar, CA (US)

(73) Assignee: Patio 2 Pool, LLC, Los Angeles, CA (US)

( * ) Notice: Subject to any disclaimer, the term of this patent is extended or adjusted under 35 U.S.C. 154(b) by 417 days.

(21) Appl. No.: 14/119,553

(22) PCT Filed: Jun. 18, 2012

(86) PCT No.: PCT/US2012/043003
§ 371 (c)(1),
(2), (4) Date: Apr. 22, 2014

(87) PCT Pub. No.: WO2012/174560
PCT Pub. Date: Dec. 20, 2012

(65) Prior Publication Data

US 2014/0237713 A1 Aug. 28, 2014

Related U.S. Application Data

(60) Provisional application No. 61/498,123, filed on Jun. 17, 2011, provisional application No. 61/526,198, filed on Aug. 22, 2011.

(51) Int. Cl.
*E04H 4/00* (2006.01)
*E04H 4/14* (2006.01)
(Continued)

(52) U.S. Cl.
CPC ..... *E04H 4/14* (2013.01); *E04H 4/065* (2013.01); *E04H 4/16* (2013.01)

(58) Field of Classification Search
CPC ..... E04G 1/22; E04H 4/065; E04H 4/084
(Continued)

(56) References Cited

U.S. PATENT DOCUMENTS 1,727,182 A * 9/1929 Smith ..... B66F 7/0608 187/211
2,471,901 A * 5/1949 Ross ..... B66F 7/0625 182/16
(Continued)

FOREIGN PATENT DOCUMENTS

DE 2261404 A1 6/1974
FR 2792020 A1 10/2000
(Continued)

*Primary Examiner* — Allana Lewin Bidder
*Assistant Examiner* — Nicholas Ros
(74) *Attorney, Agent, or Firm* — Kelly & Kelley, LLP

(57) ABSTRACT

A variable depth swimming pool/spa can comprise a movable deck and a bottom. The movable deck can be movable relative to the bottom of a variable depth swimming pool/spa to provide for a variable depth of the portion of pool/spa that is accessible to a pool/spa user. The movable deck can be connected to the bottom of the variable depth swimming pool/spa via one or several legs. The one or several legs can be rotatingly connected to the movable deck and can be slidingly connected to the bottom of the swimming pool/spa. The rotational displacement of the legs can result in the vertical displacement of the movable deck. The legs can be connected to synchronizing arms that can interact with a synchronizing drive to coordinate the movement of a first leg with a second leg.

23 Claims, 30 Drawing Sheets

(51) Int. Cl.
*E04H 4/06* (2006.01)
*E04H 4/16* (2006.01)

(58) Field of Classification Search
USPC ..... 182/141; 187/211, 215; 4/490, 495, 501, 4/661; 52/169.7
See application file for complete search history.

(56) References Cited

U.S. PATENT DOCUMENTS

| | | | | | |
|---|---|---|---|---|---|
| 3,774,725 | A * | 11/1973 | Pelouch | B66C 7/08 | 187/205 |
| 3,813,704 | A * | 6/1974 | Troiano | E04H 4/065 | 4/499 |
| 3,935,600 | A * | 2/1976 | Scribner | E04H 4/065 | 187/211 |
| 4,114,206 | A * | 9/1978 | Franc | E04H 4/169 | 134/167 R |
| 4,918,766 | A * | 4/1990 | Leonaggeo, Jr. | A61D 11/00 | 119/674 |
| 5,727,655 | A * | 3/1998 | Pitman | B66F 7/08 | 108/145 |
| 5,753,112 | A | 5/1998 | Barnes | | |
| 2007/0220667 | A1* | 9/2007 | Kanetis | E04H 4/084 | 4/501 |
| 2007/0271693 | A1* | 11/2007 | Yotsuyanagi | A63B 69/125 | 4/507 |

FOREIGN PATENT DOCUMENTS

| | | | |
|---|---|---|---|
| WO | 2011/029737 | A1 | 3/2011 |
| WO | 2012/023878 | A1 | 2/2012 |

* cited by examiner

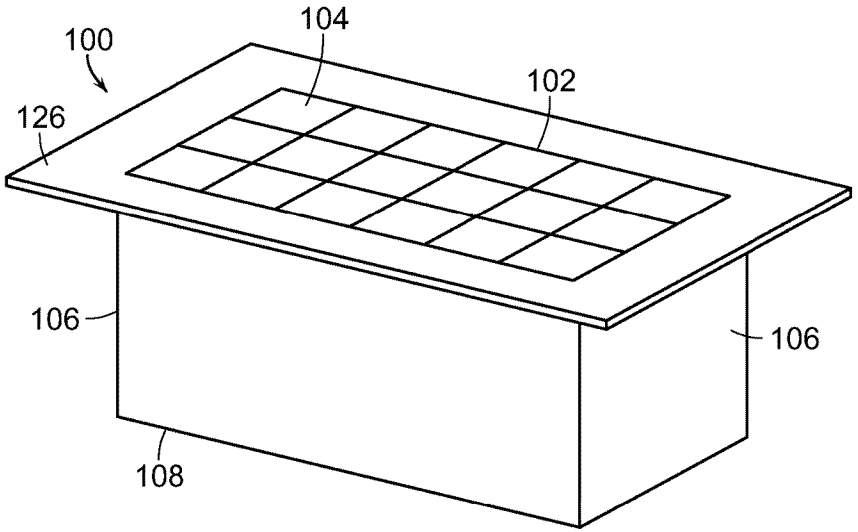
FIG. 1.1
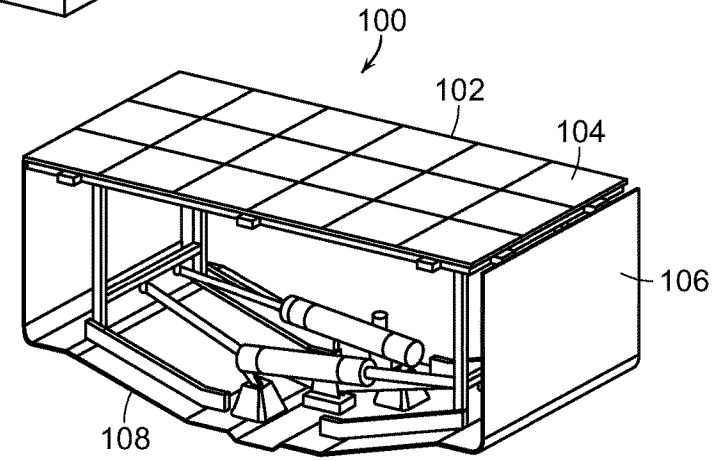
FIG. 1.3
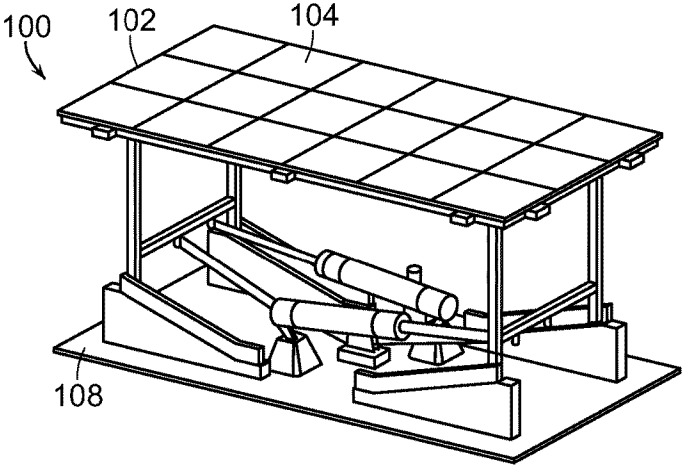
FIG. 1.2

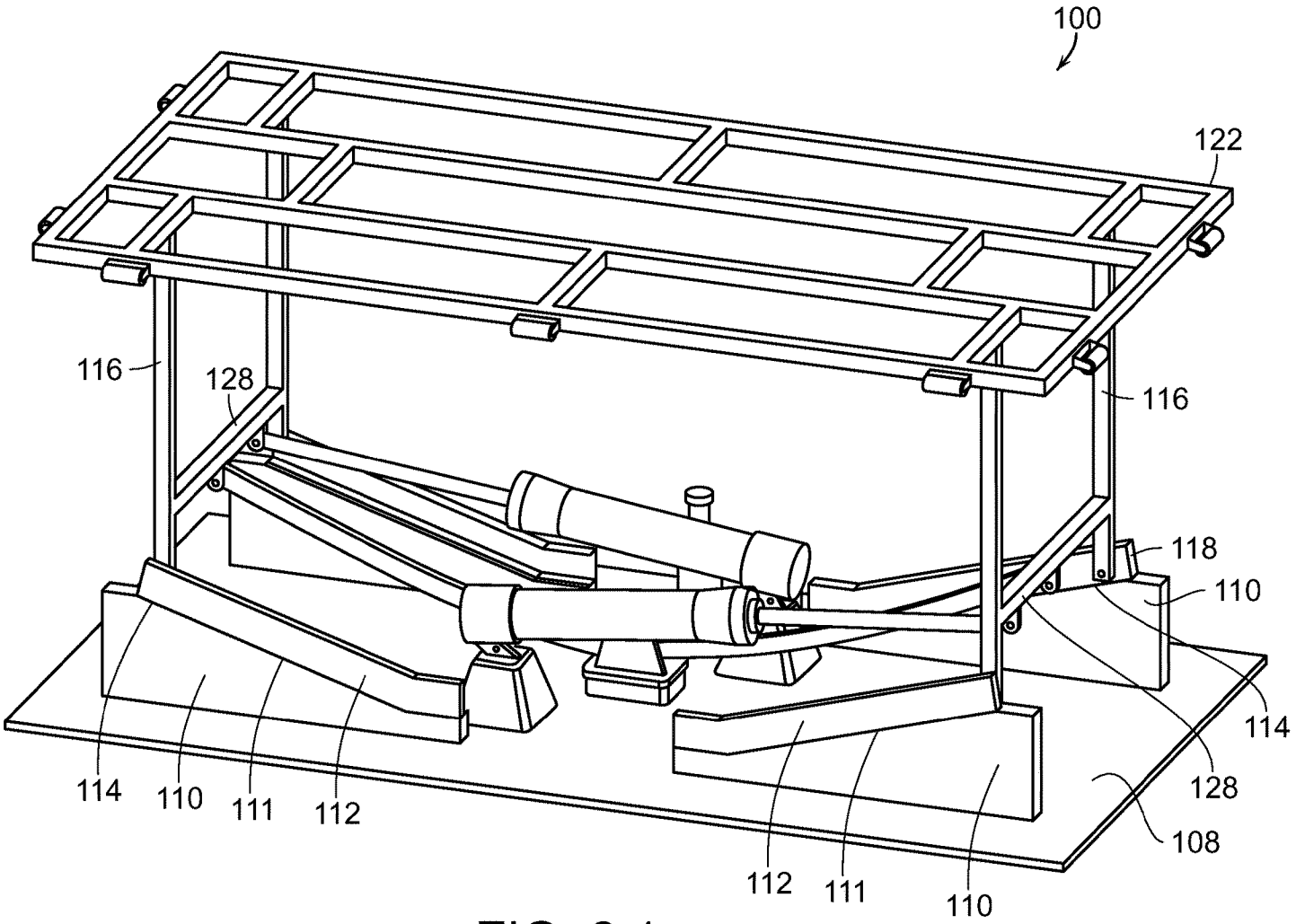
FIG. 2.1

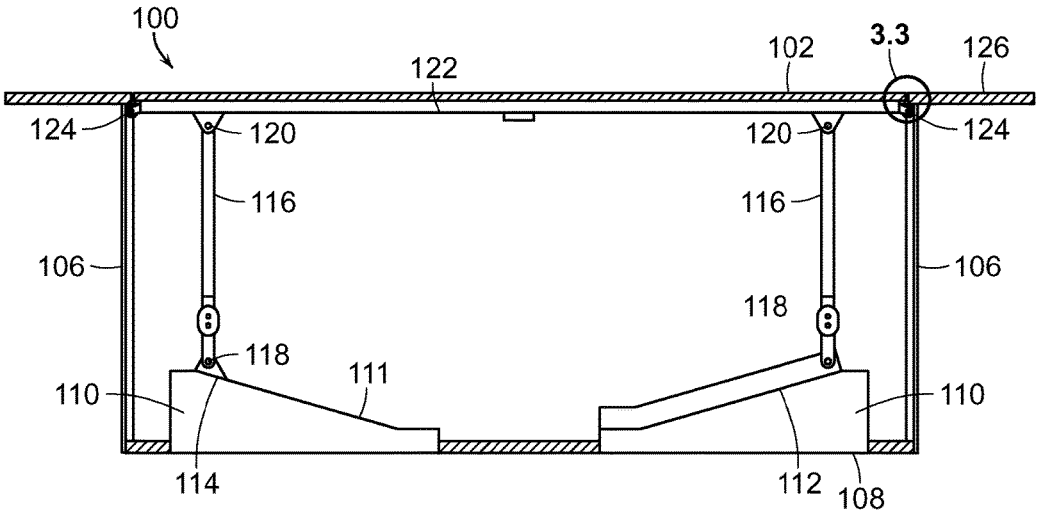
FIG. 3.1
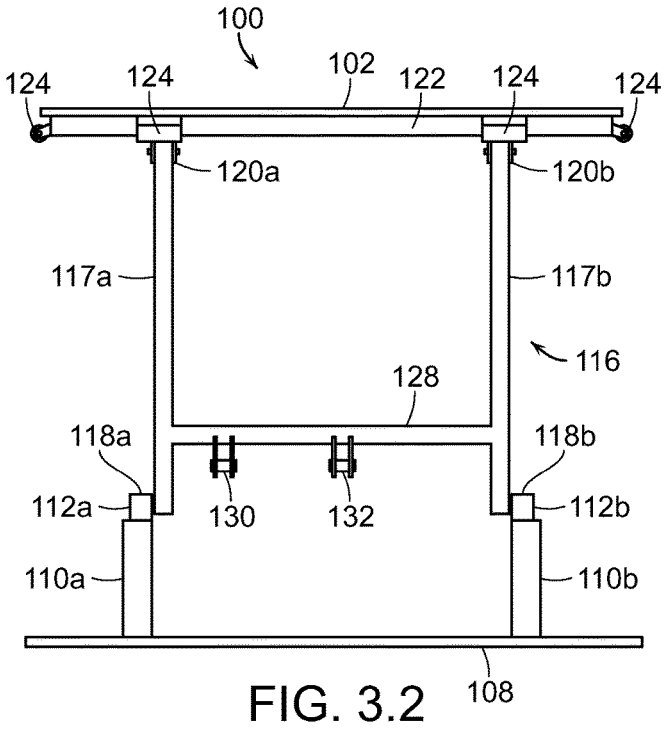
FIG. 3.2

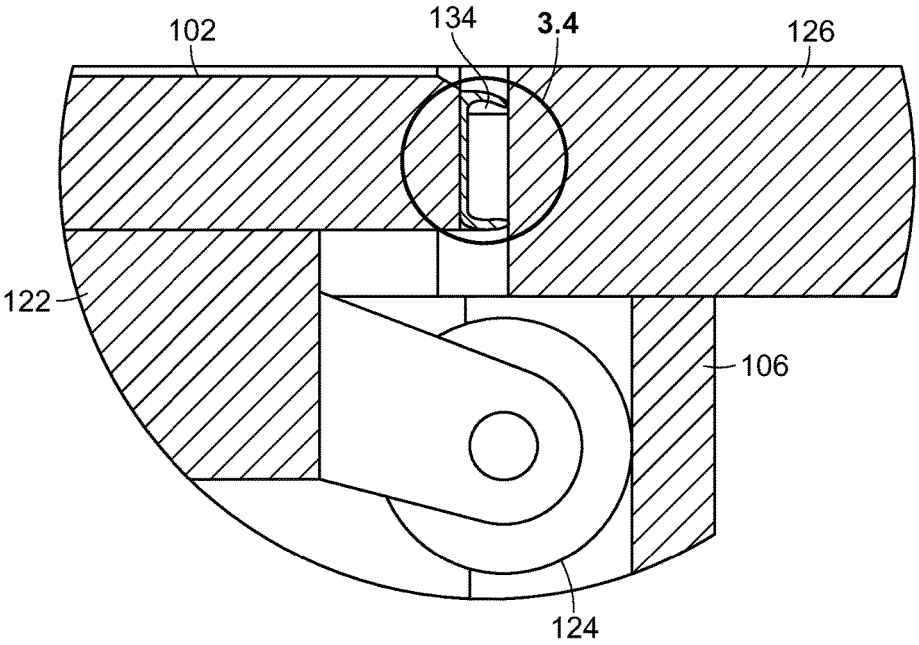
FIG. 3.3
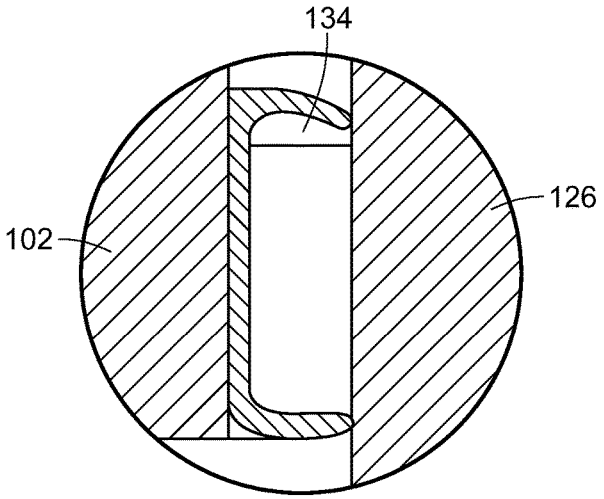
FIG. 3.4

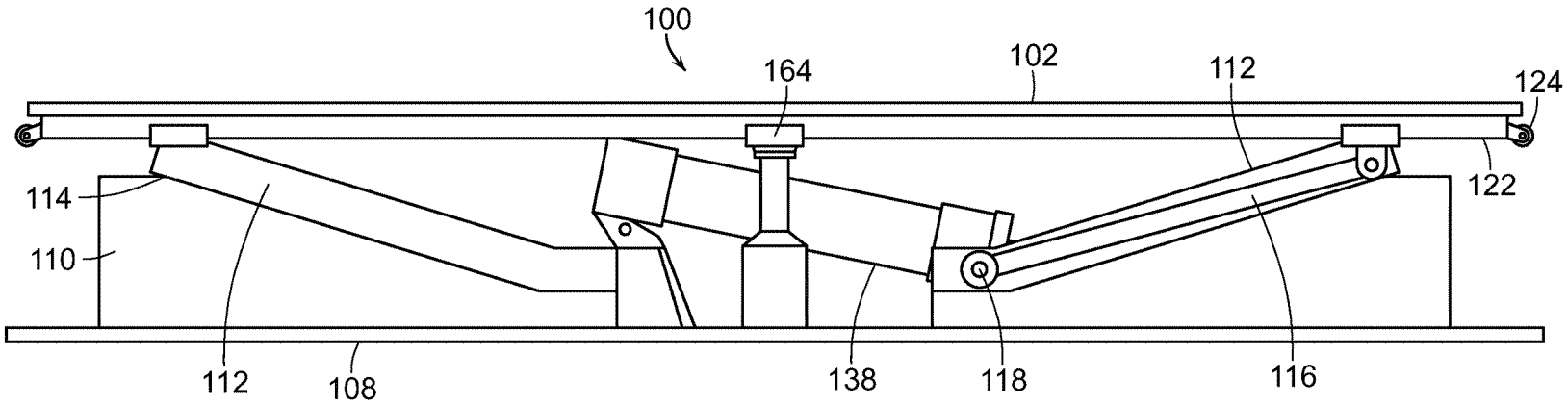
FIG. 4.1
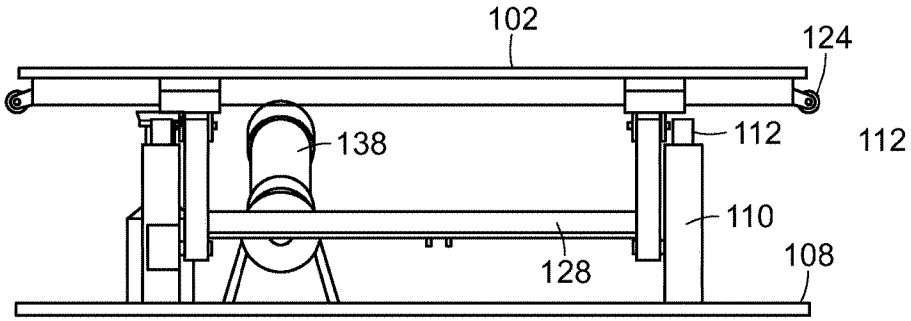
FIG. 4.2

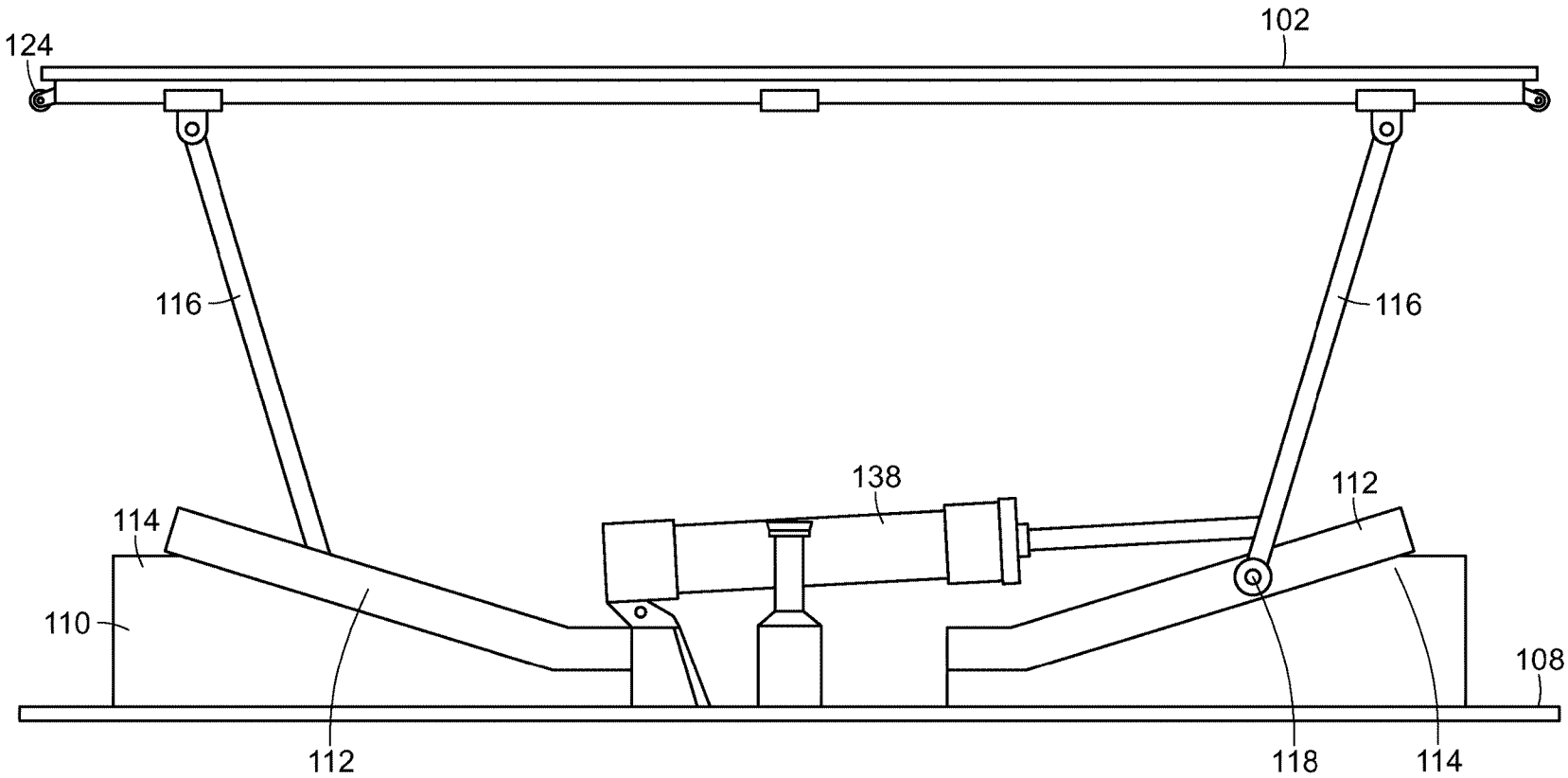
FIG. 4.3

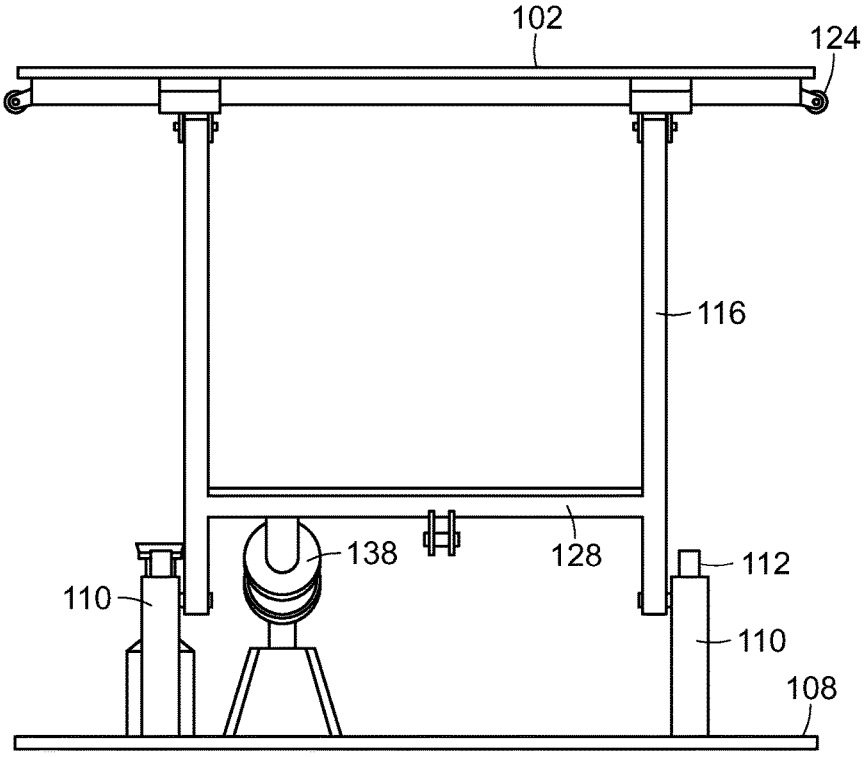
FIG. 4.4

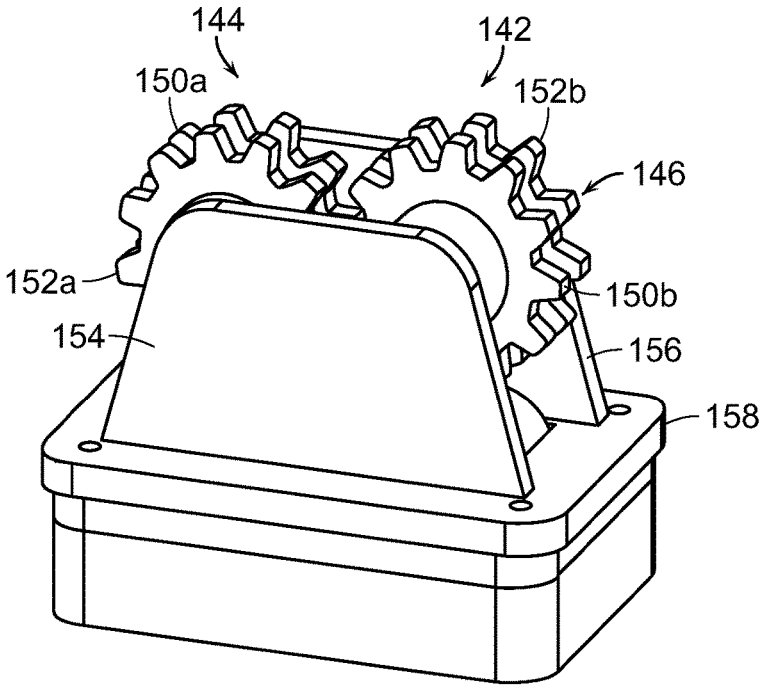
FIG. 5.1
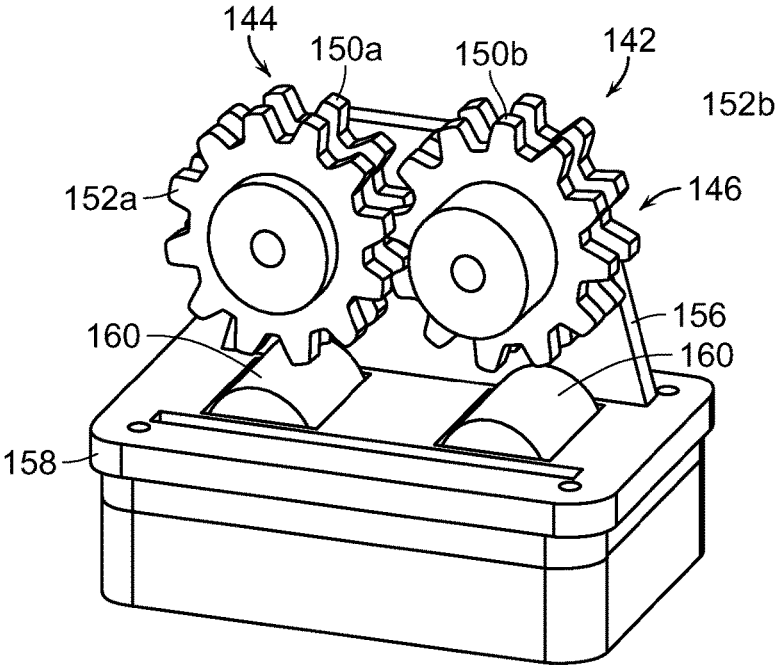
FIG. 5.2

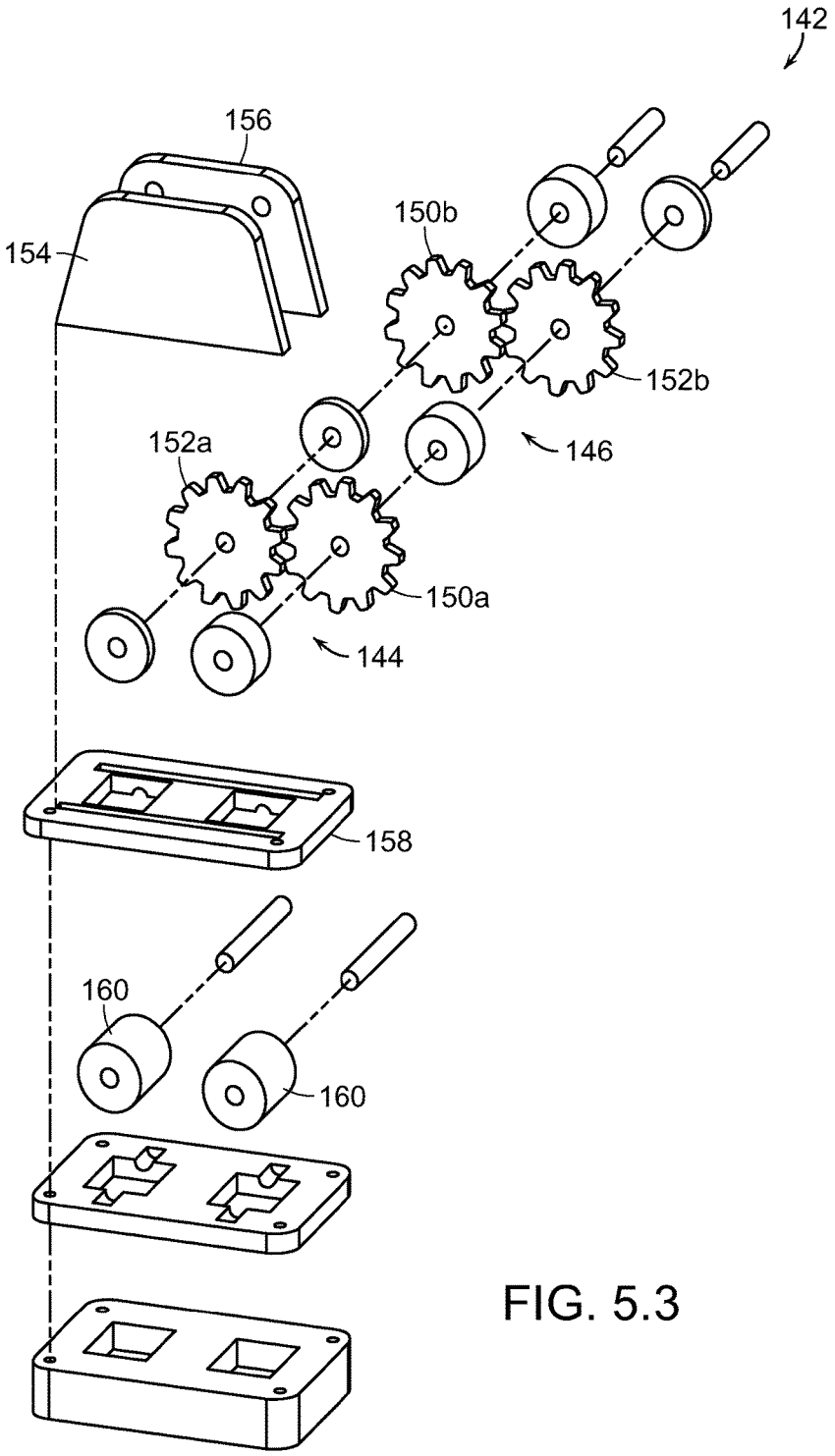
FIG. 5.3

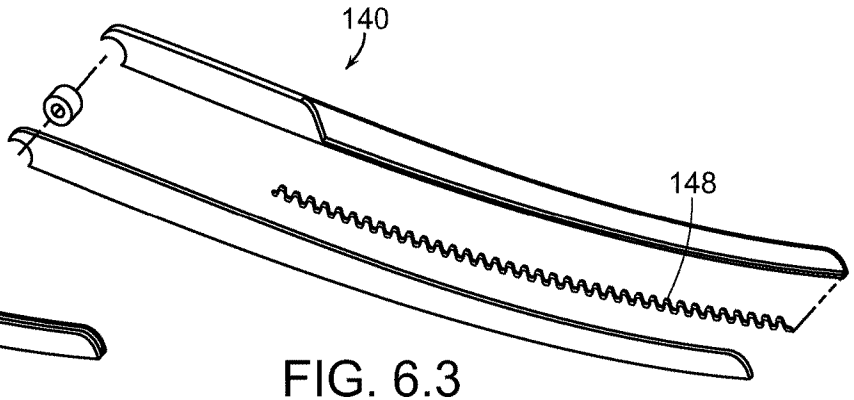
FIG. 6.3
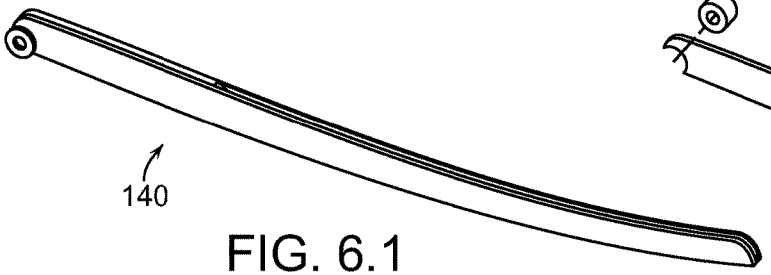
FIG. 6.1
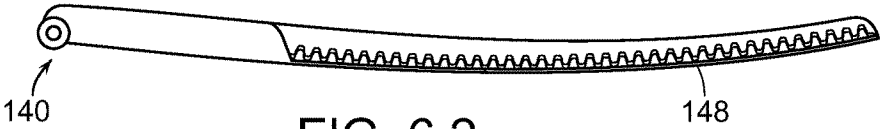
FIG. 6.2
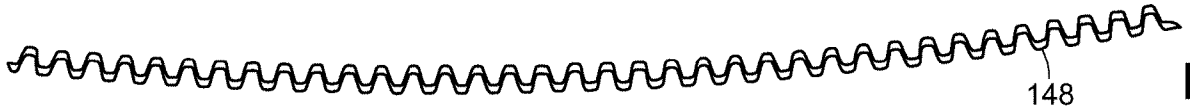
FIG. 6.4
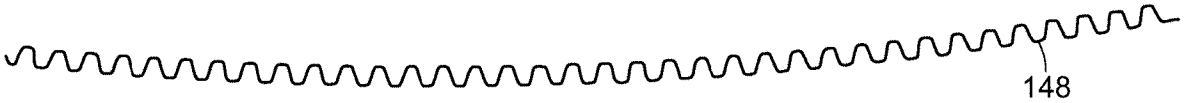
FIG. 6.5

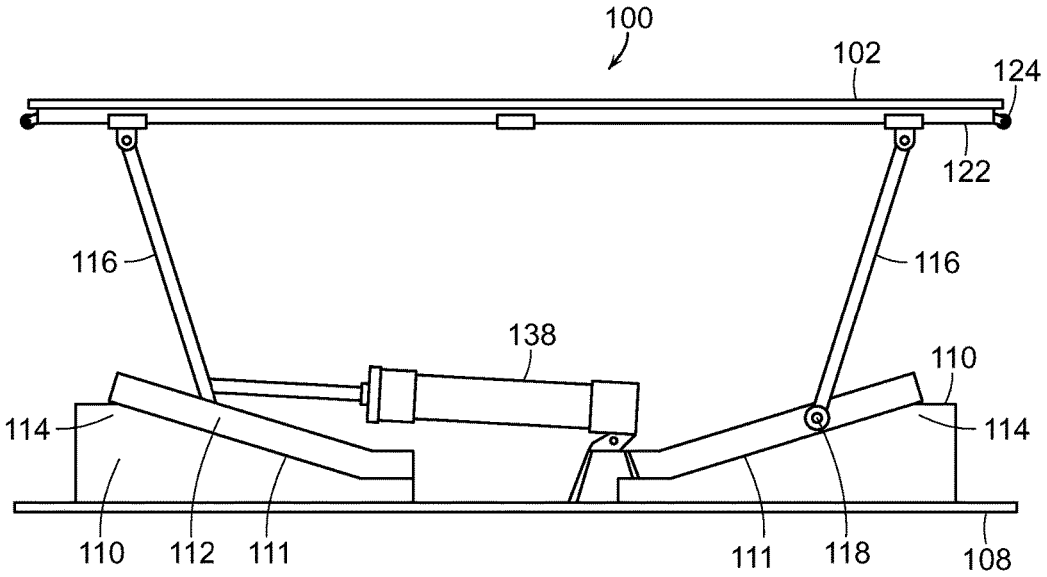
FIG. 7.1
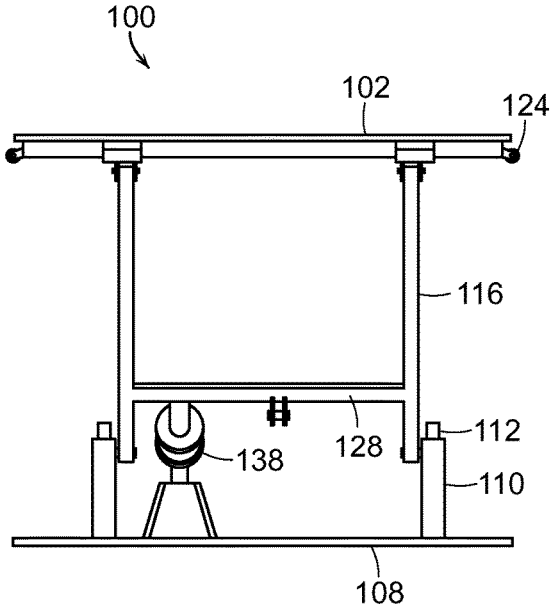
FIG. 7.2

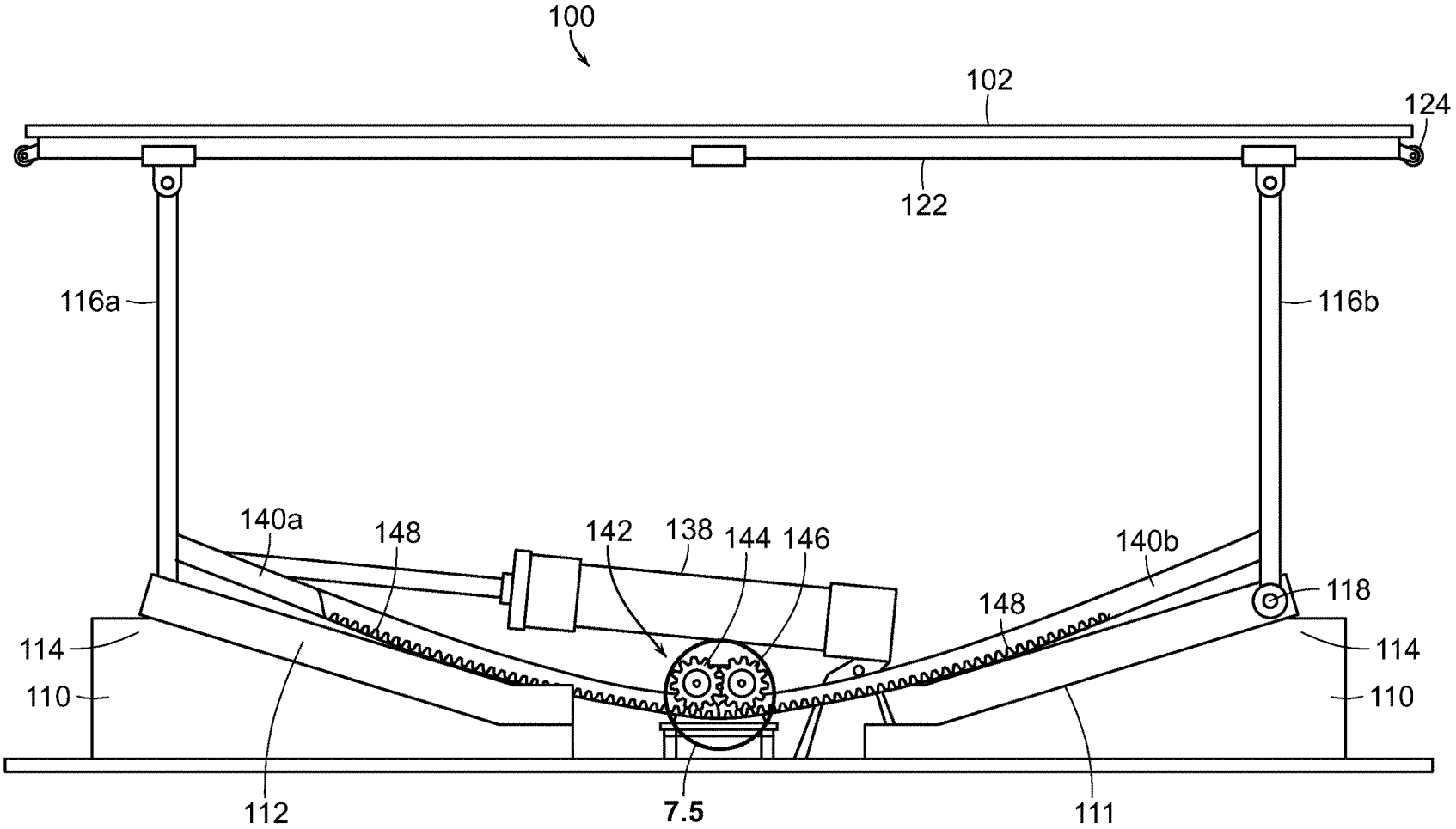
FIG. 7.3

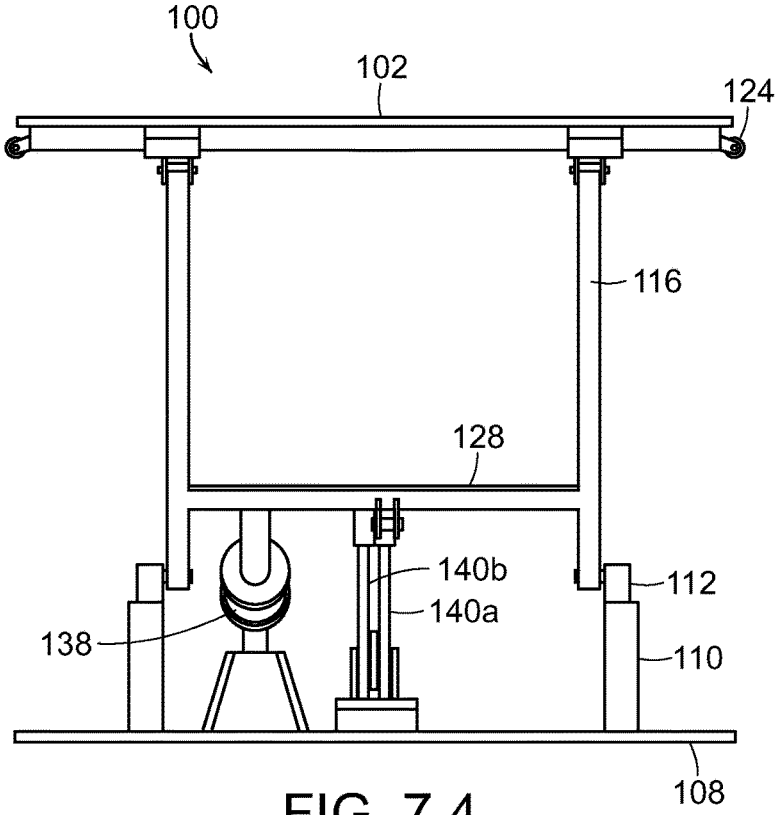
FIG. 7.4
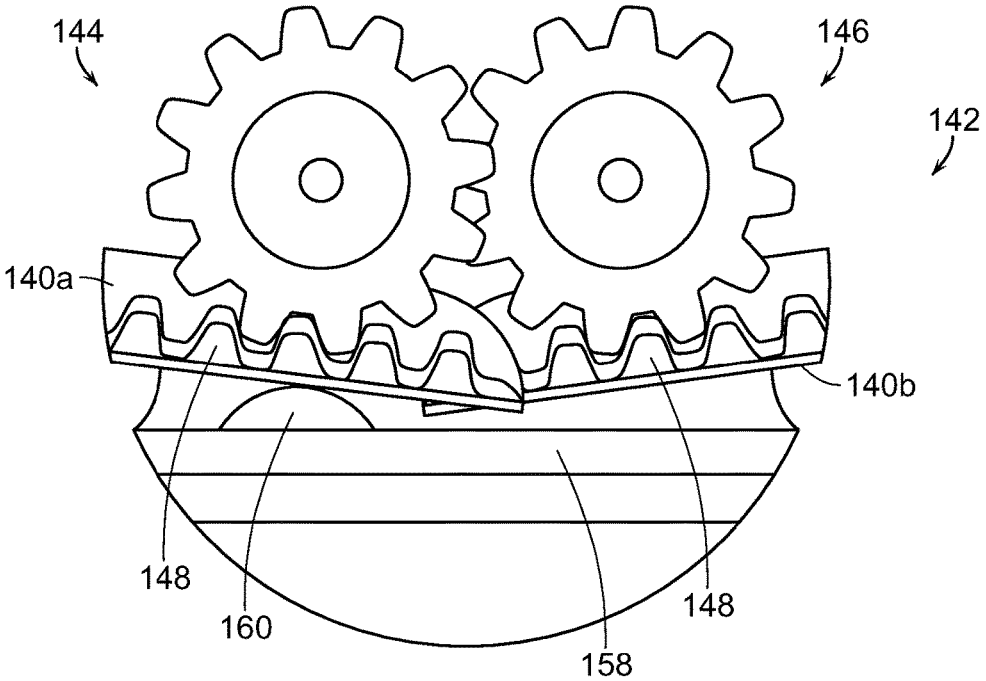
FIG. 7.5

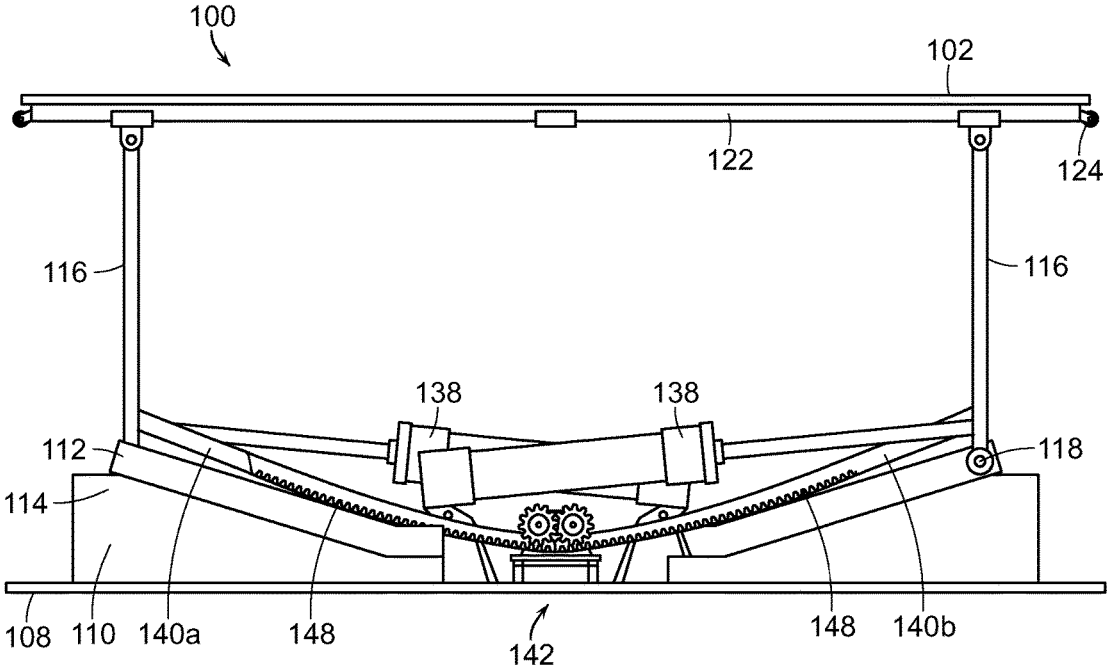
FIG. 8.1
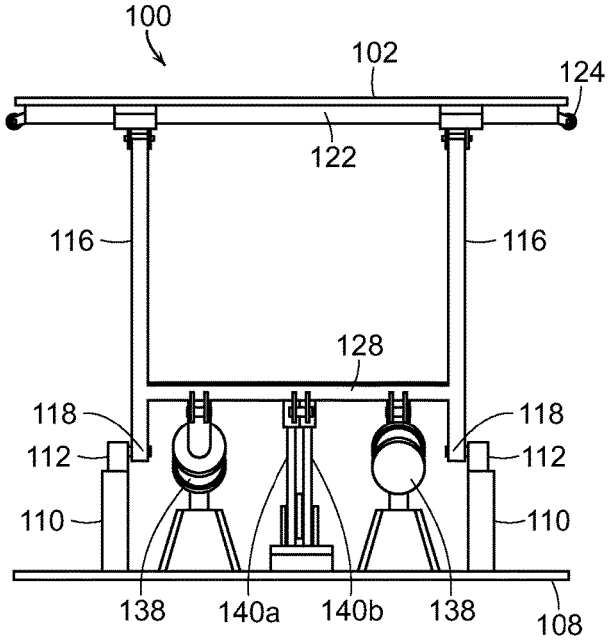
FIG. 8.2

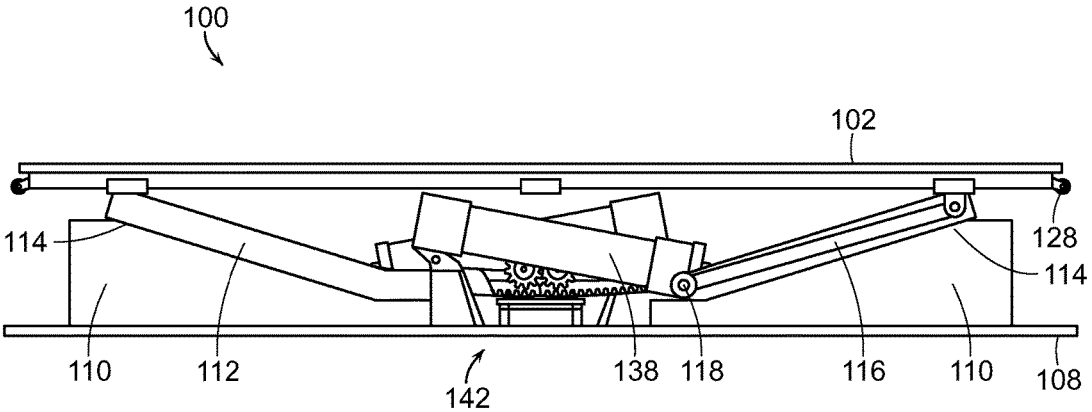
FIG. 8.3
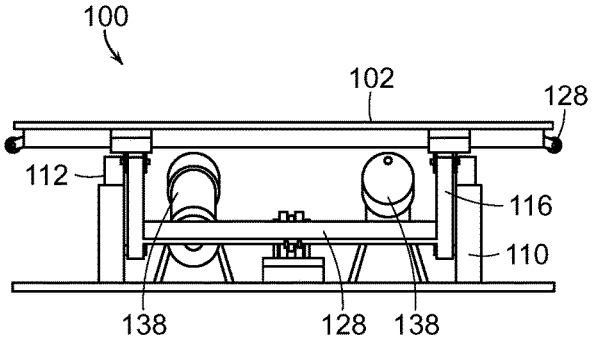
FIG. 8.4

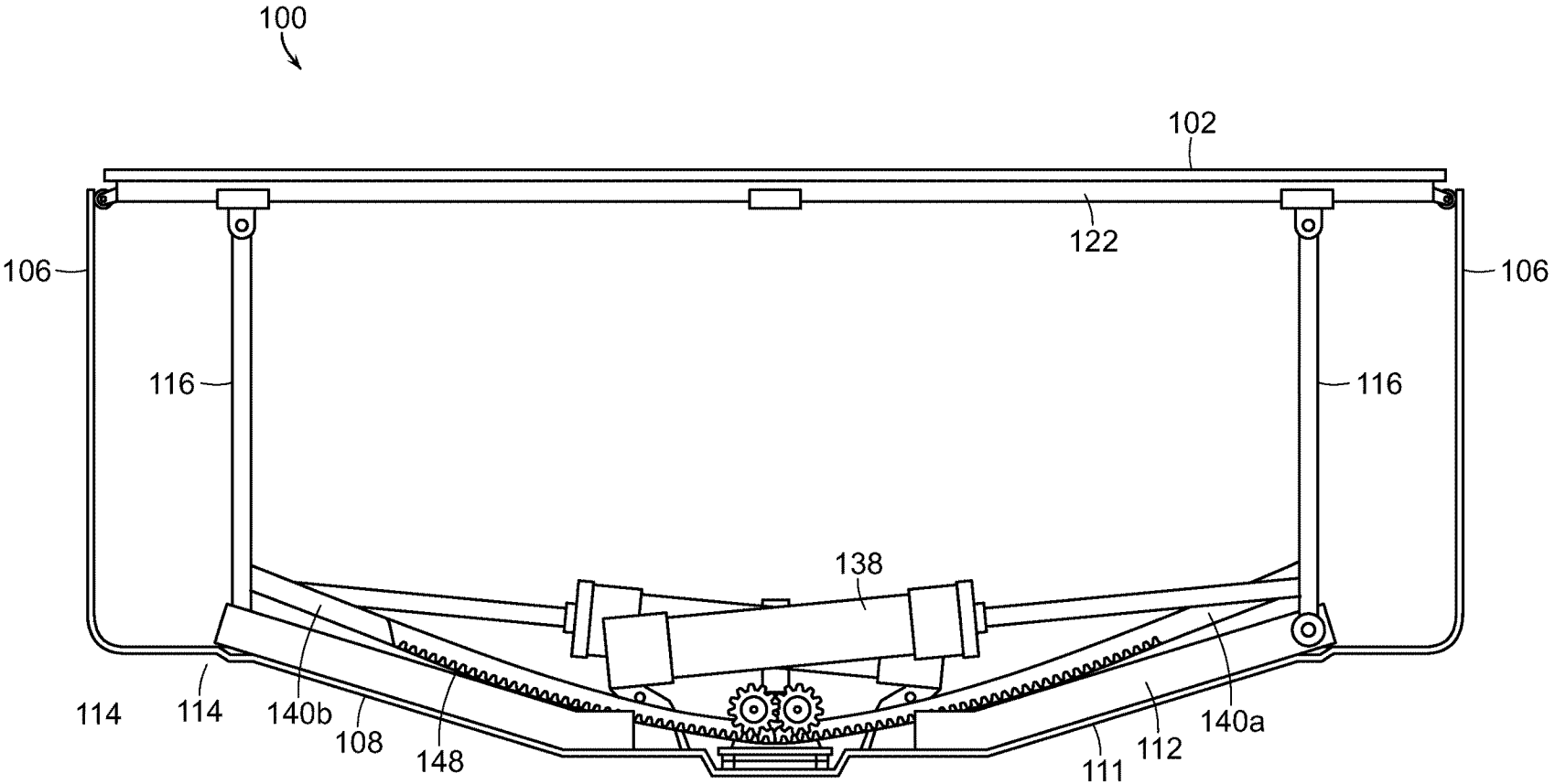
FIG. 9.1

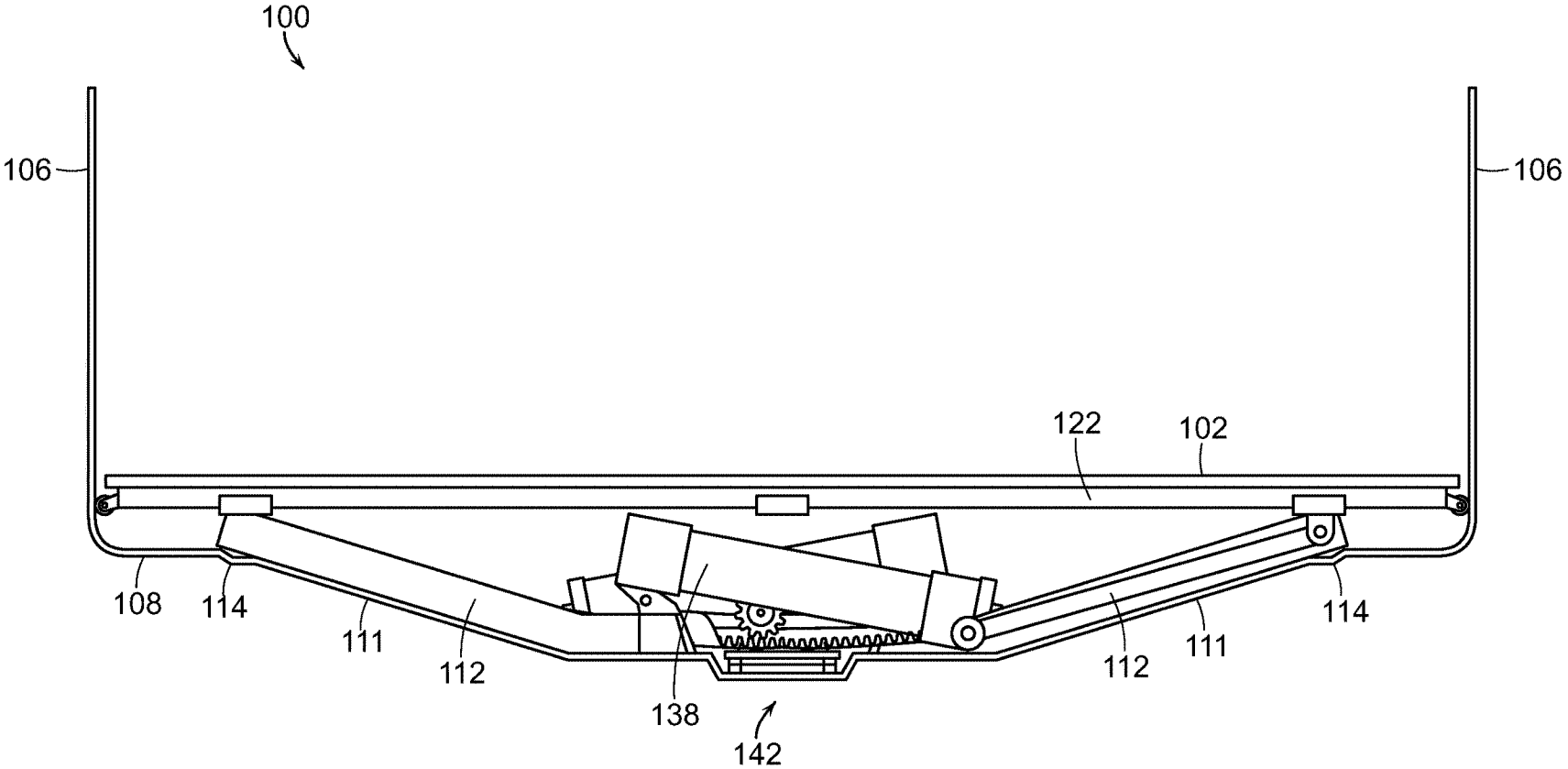
FIG. 9.2

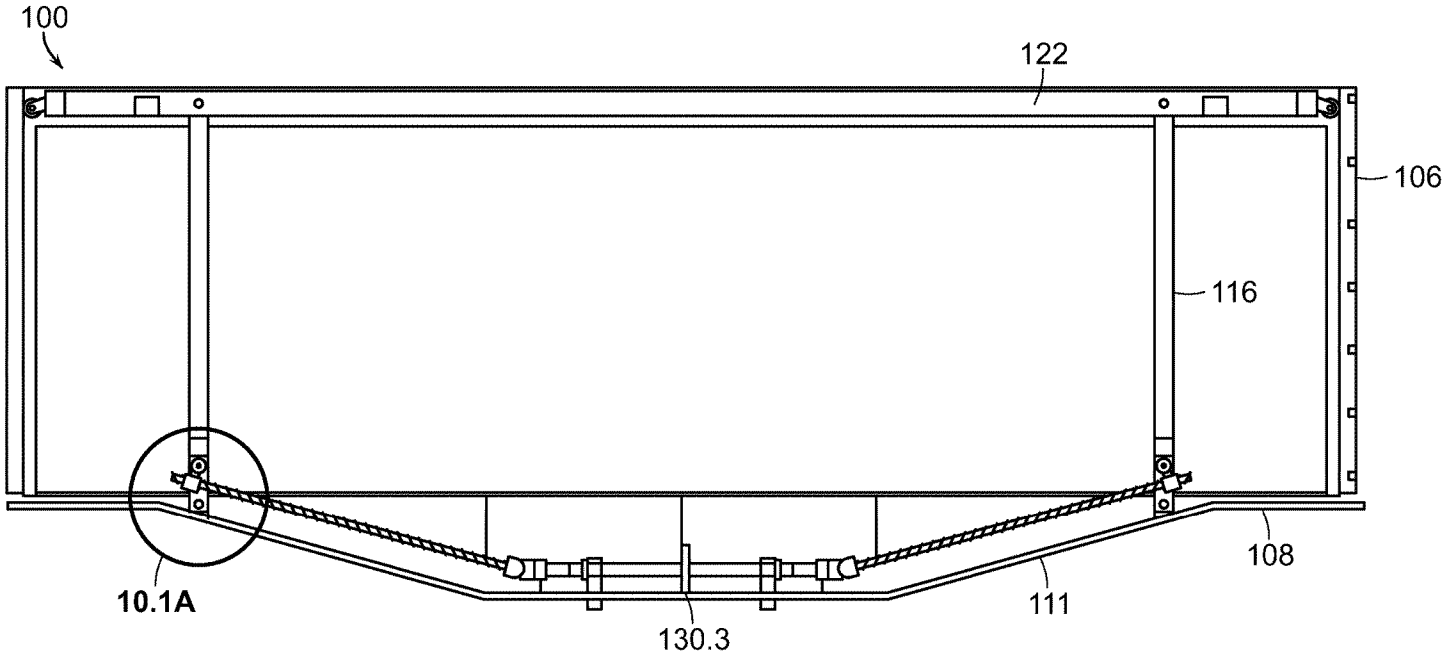
FIG. 10.1
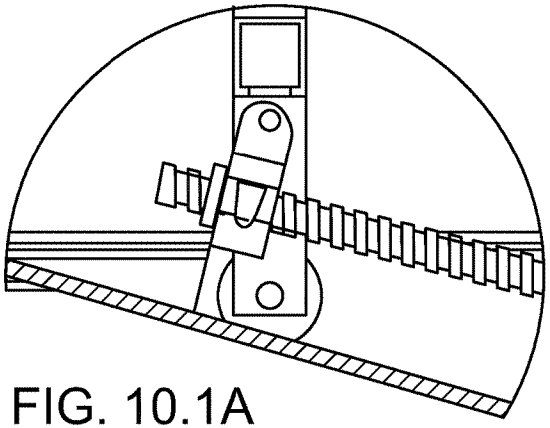
FIG. 10.1A

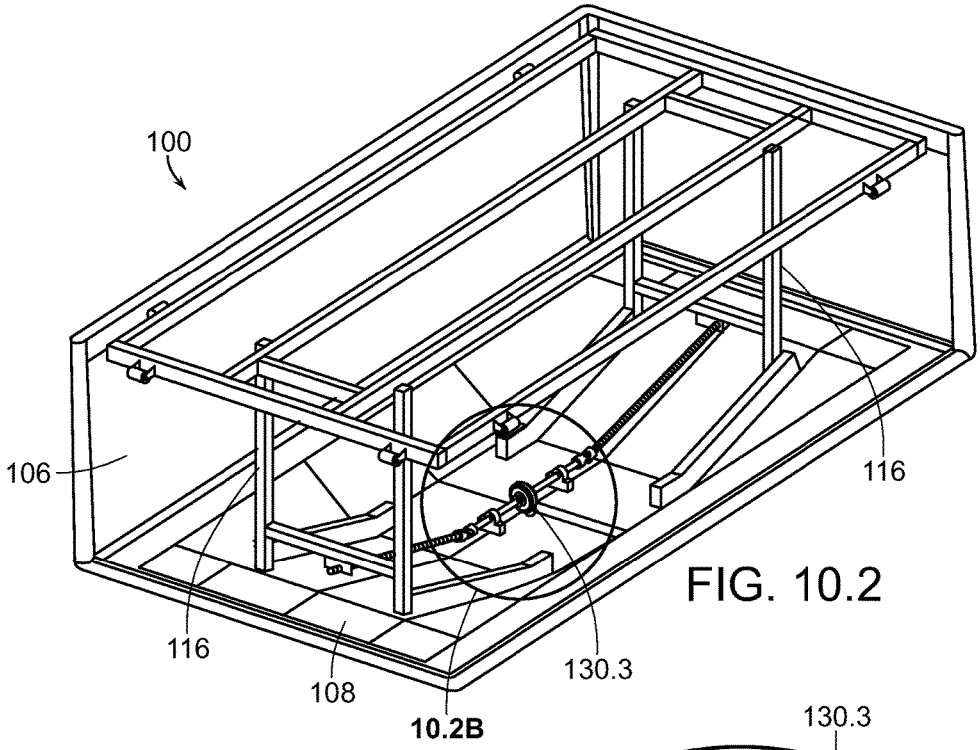
FIG. 10.2
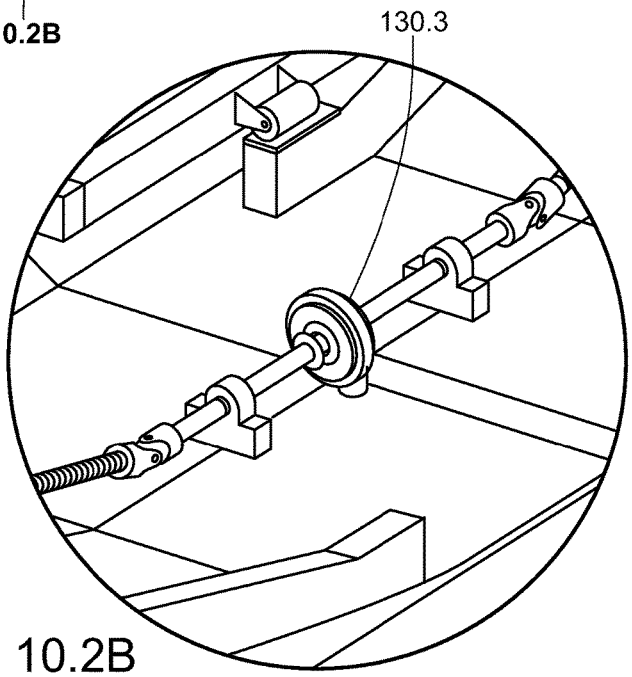
FIG. 10.2B

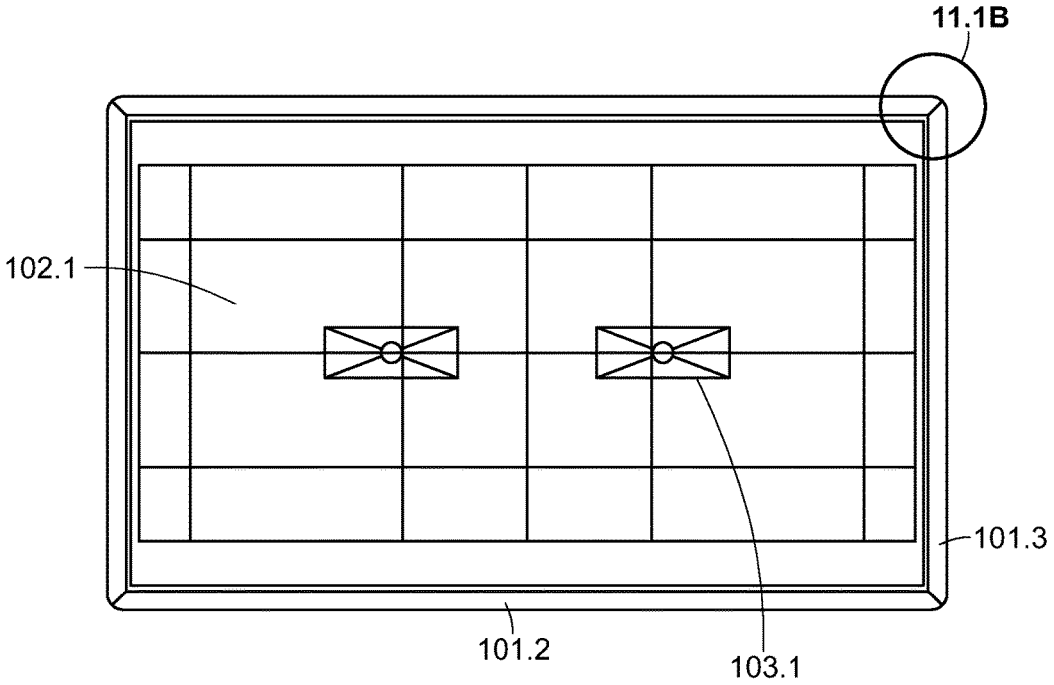
FIG. 11.1
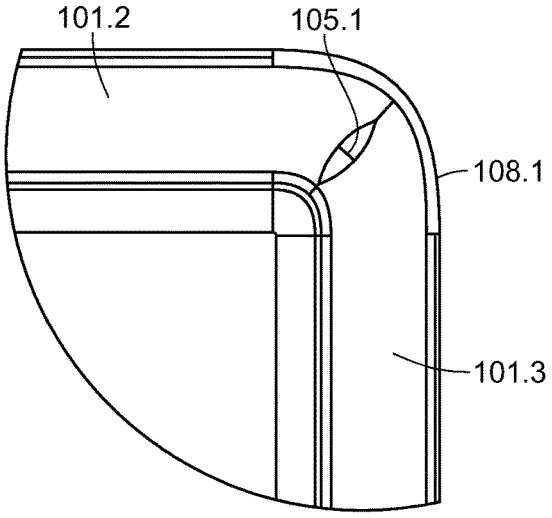
FIG. 11.1B

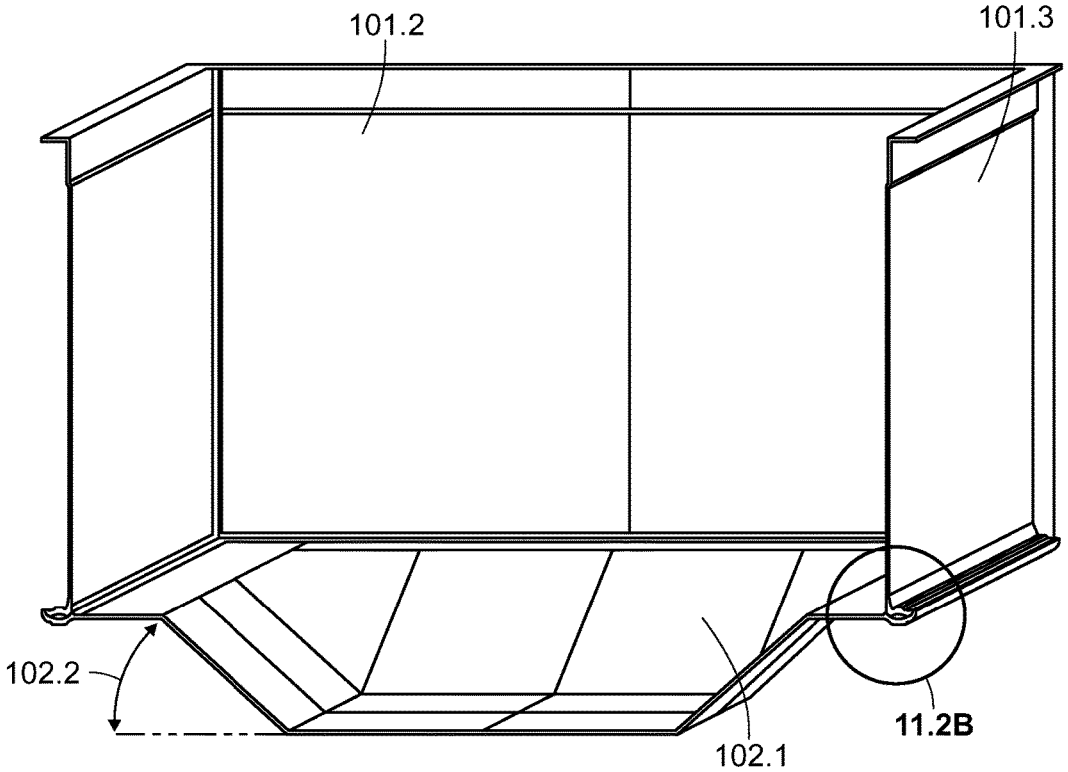
FIG. 11.2
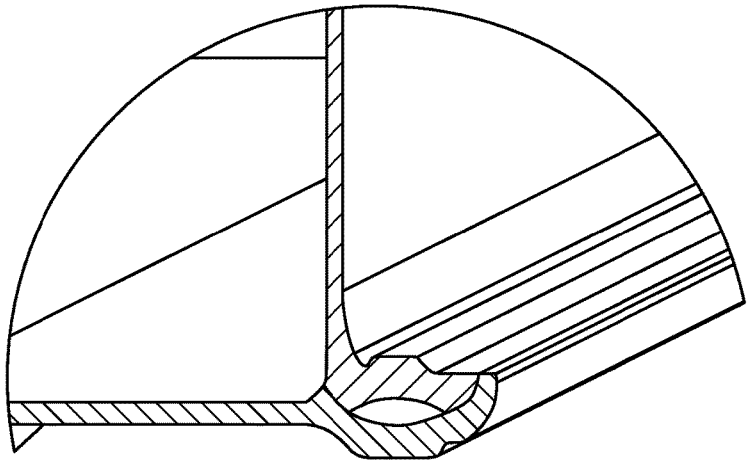
FIG. 11.2B

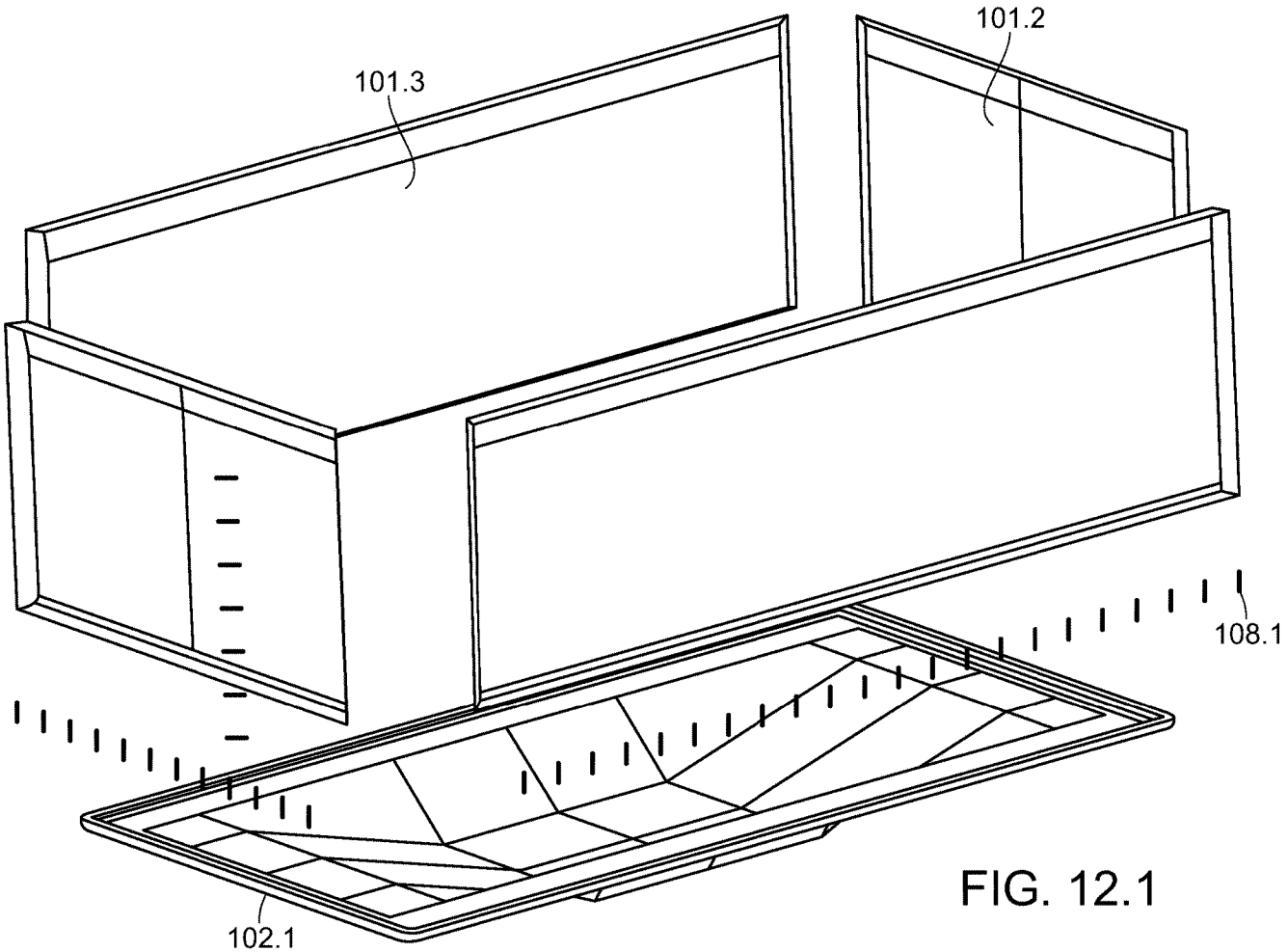
FIG. 12.1

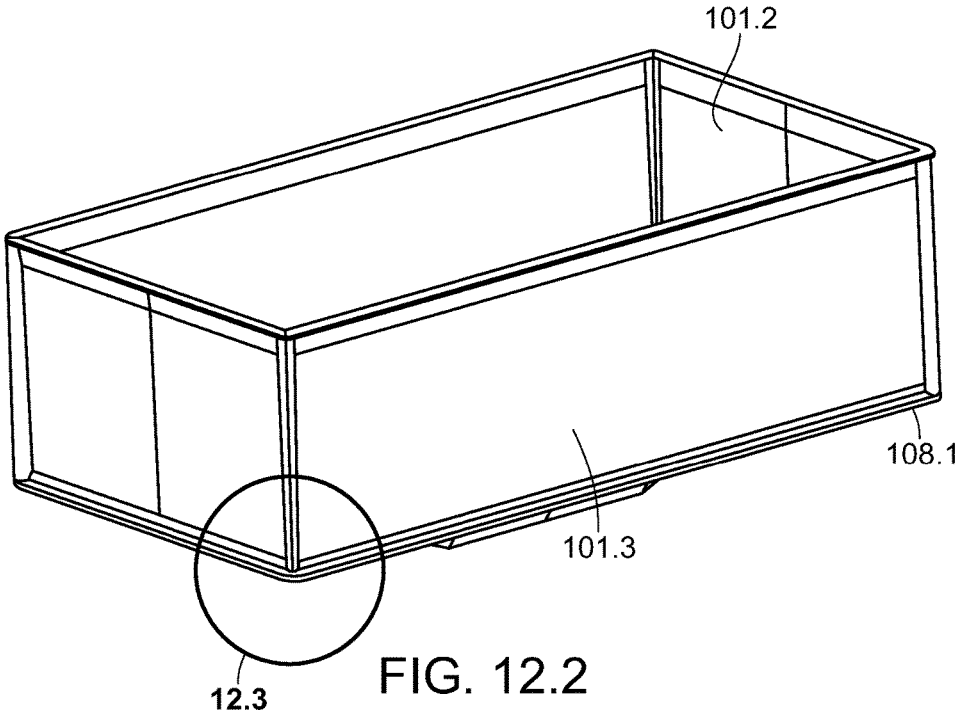
FIG. 12.2
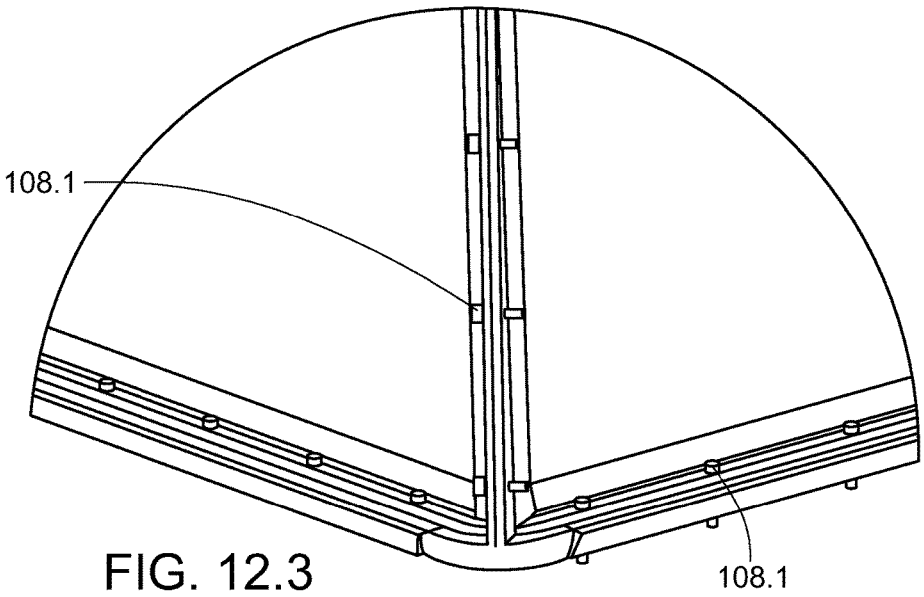
FIG. 12.3

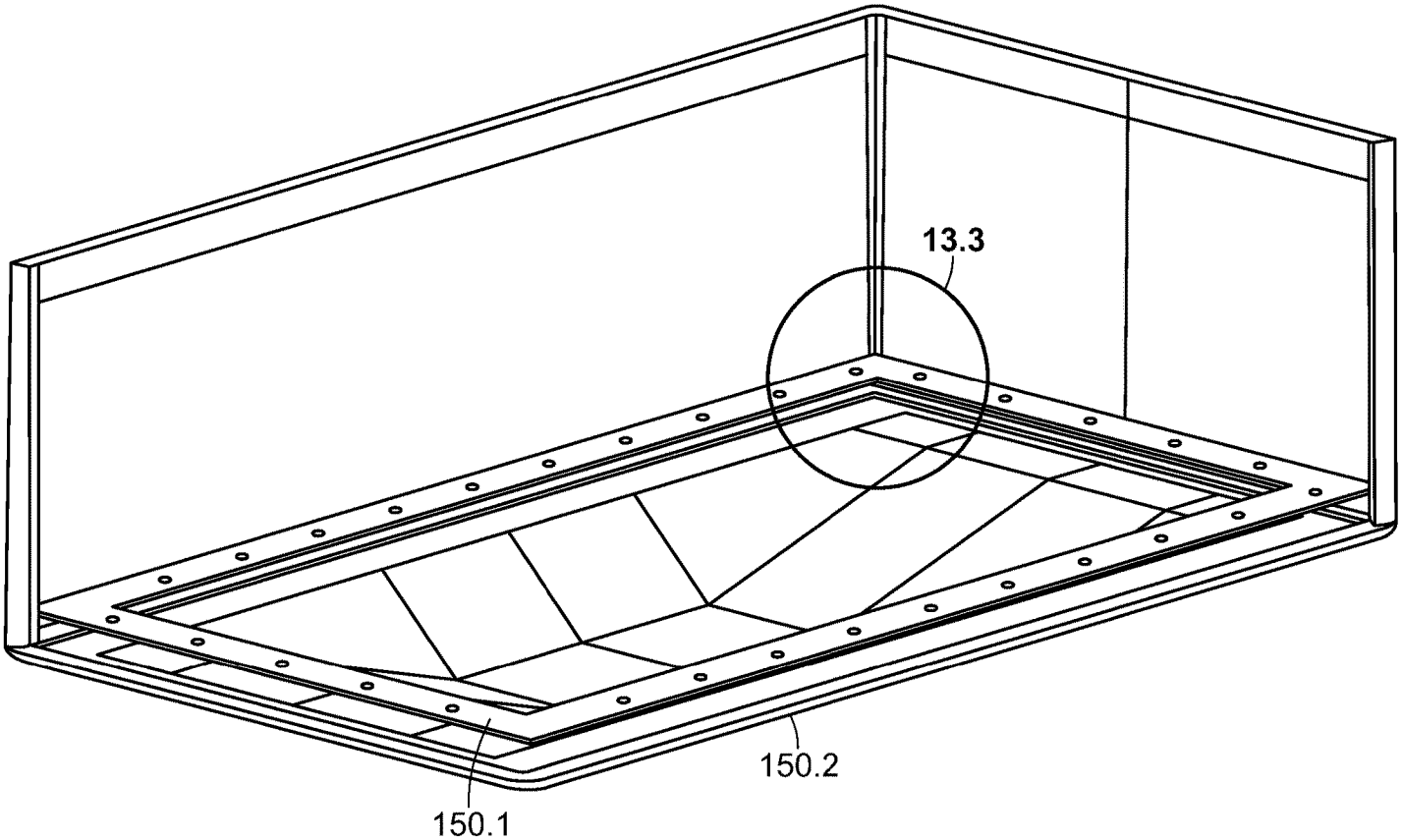
FIG. 13.1

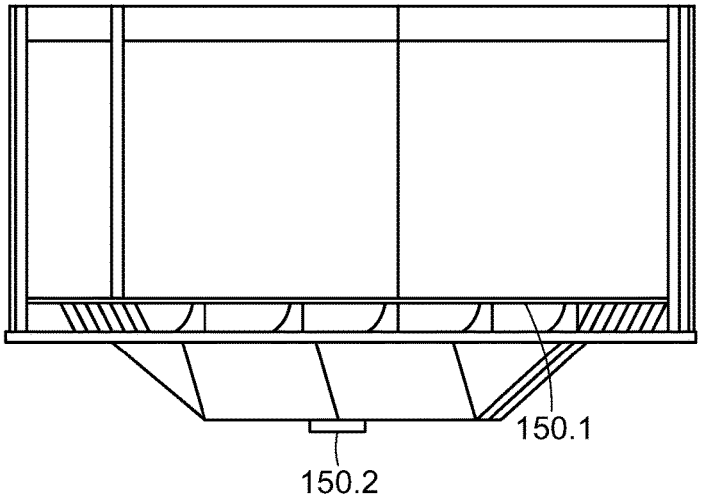
FIG. 13.2
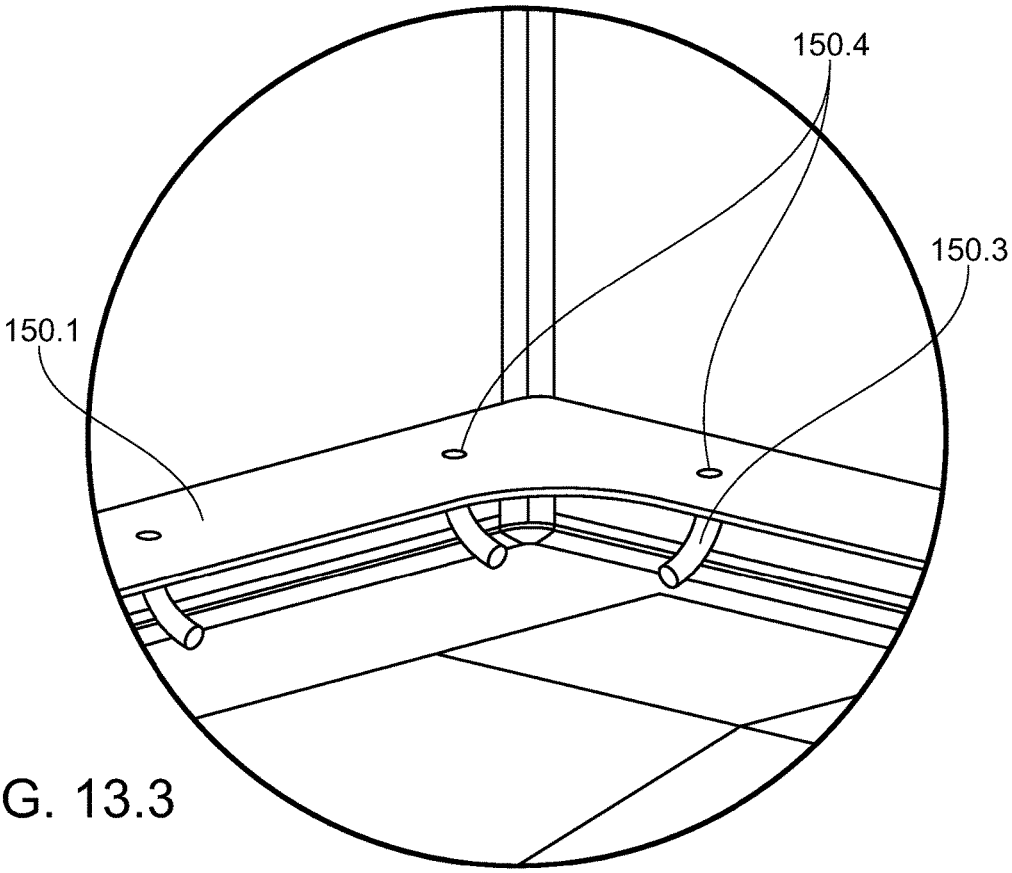
FIG. 13.3

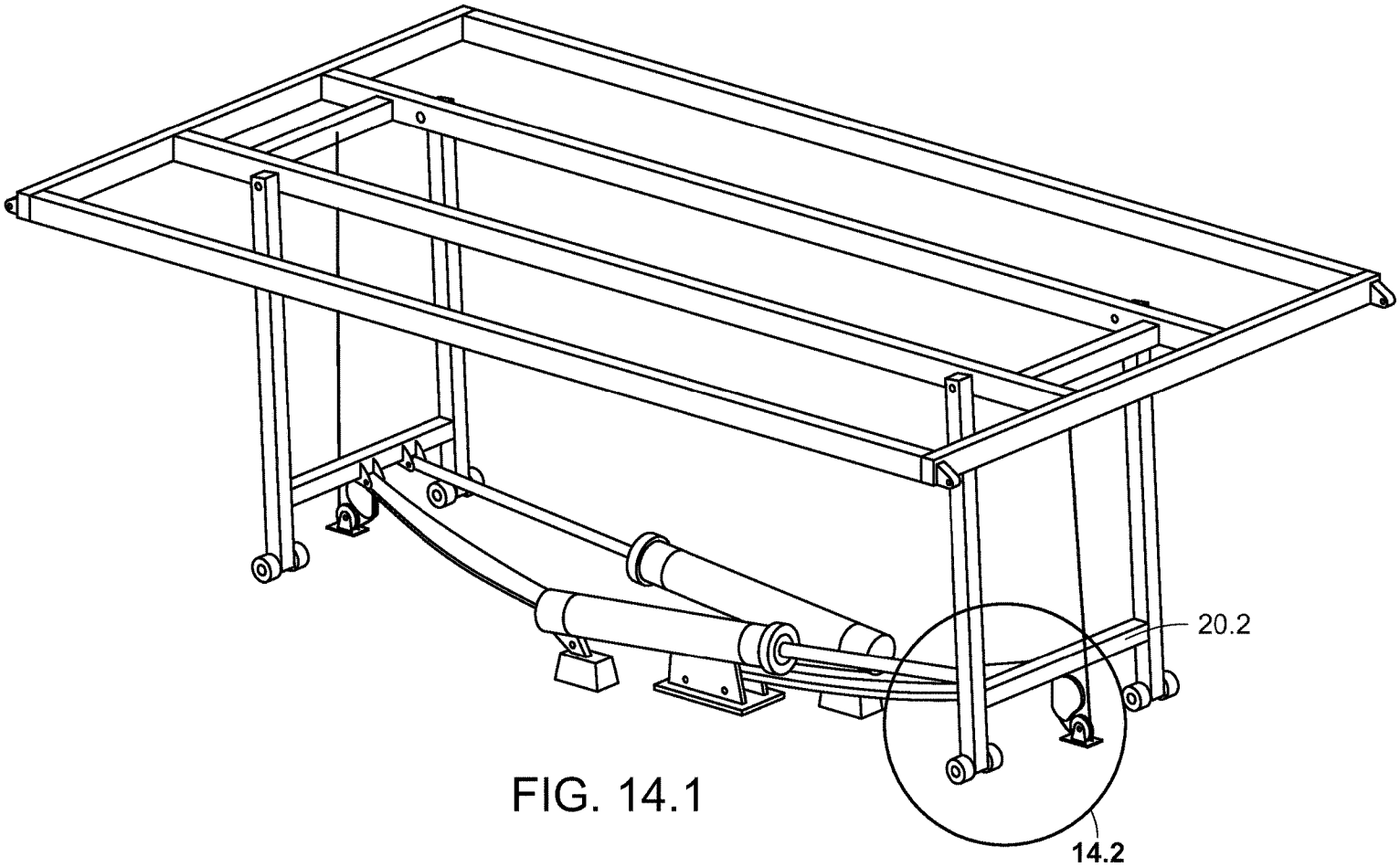
FIG. 14.1

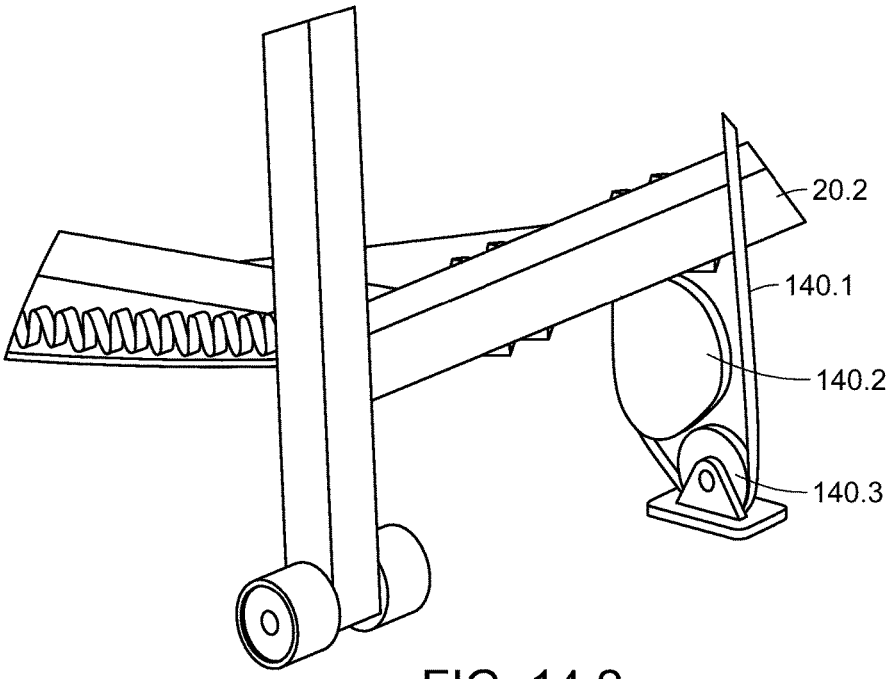
FIG. 14.2
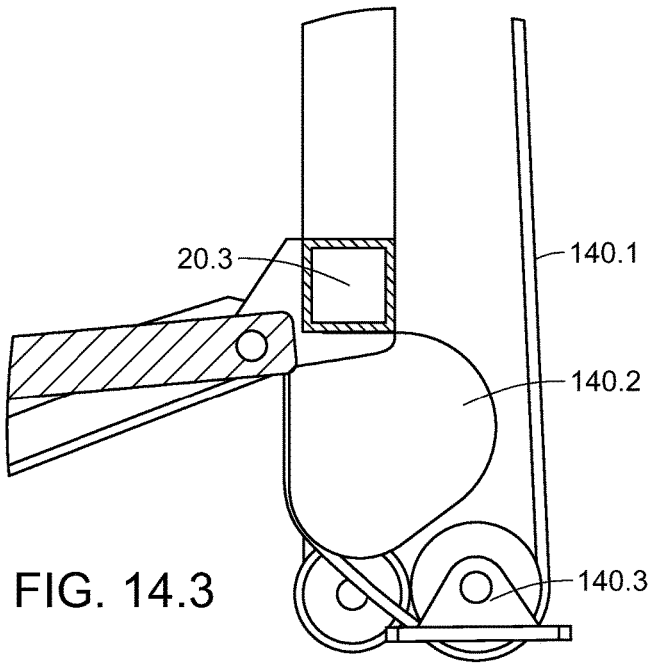
FIG. 14.3

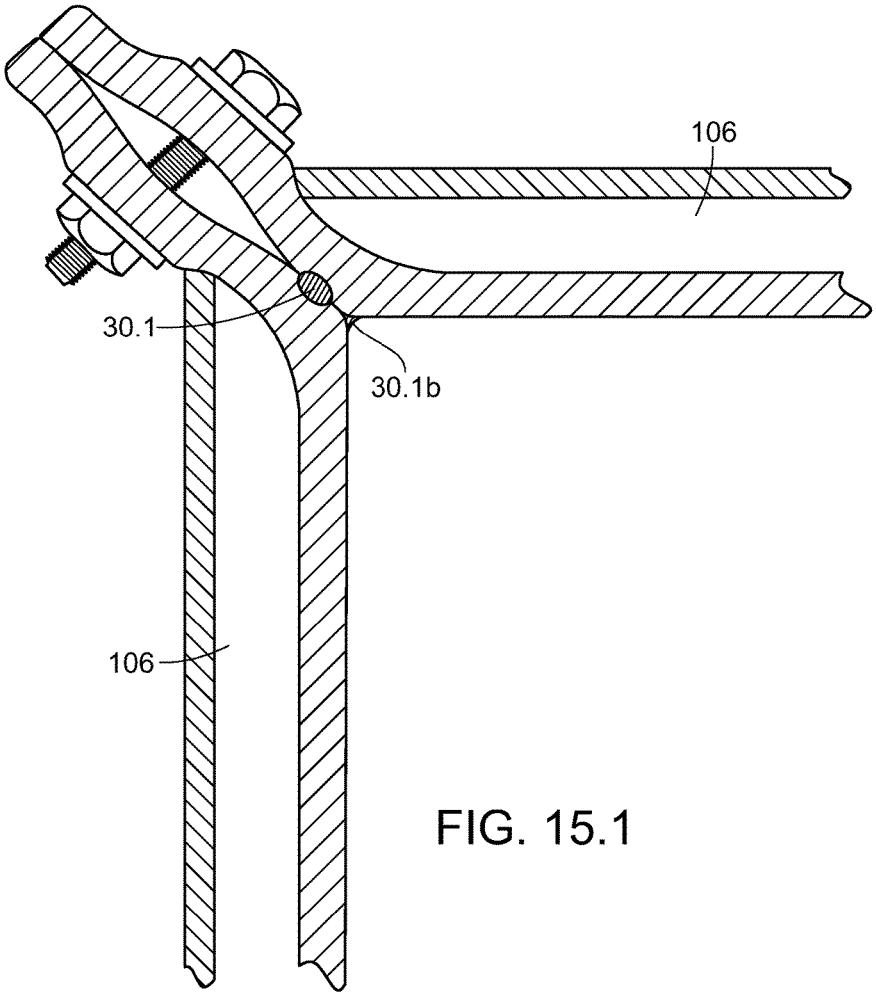
FIG. 15.1

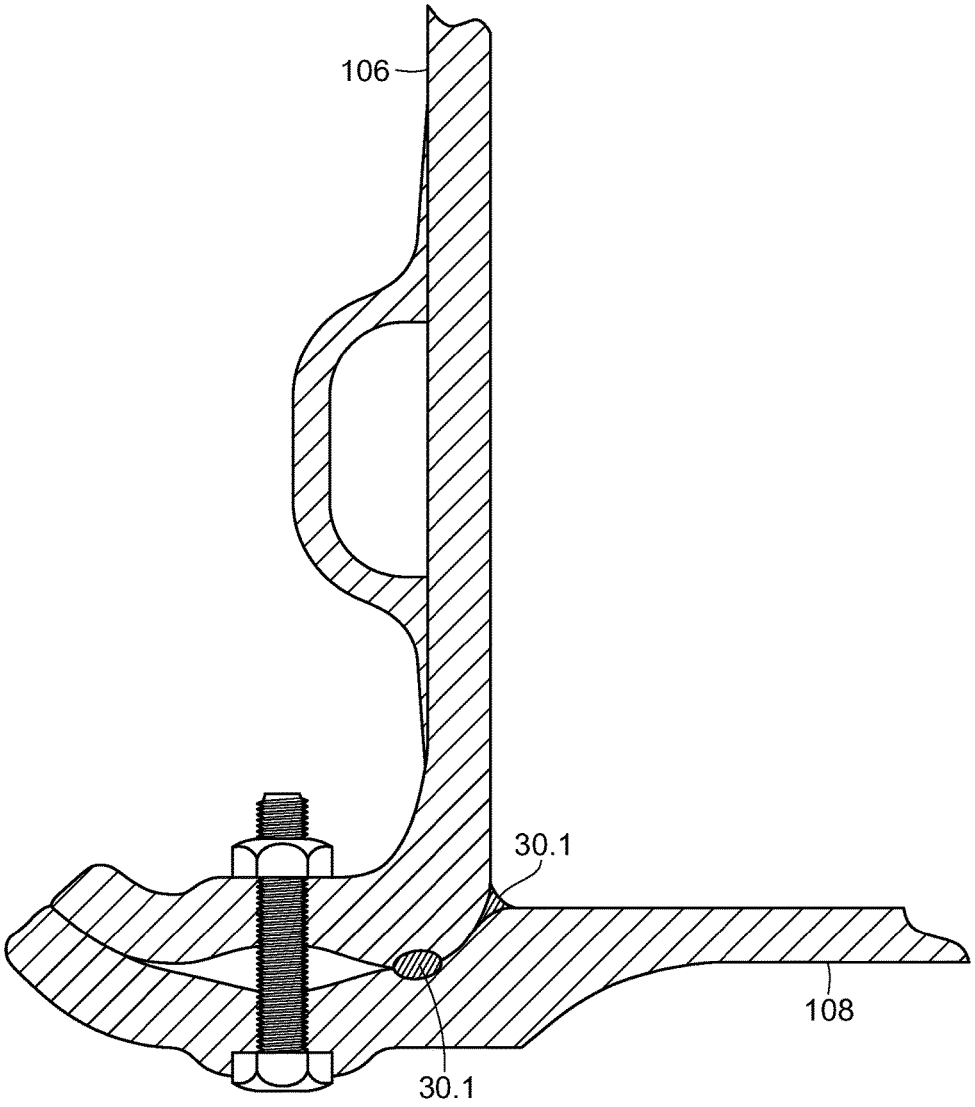
FIG. 15.2

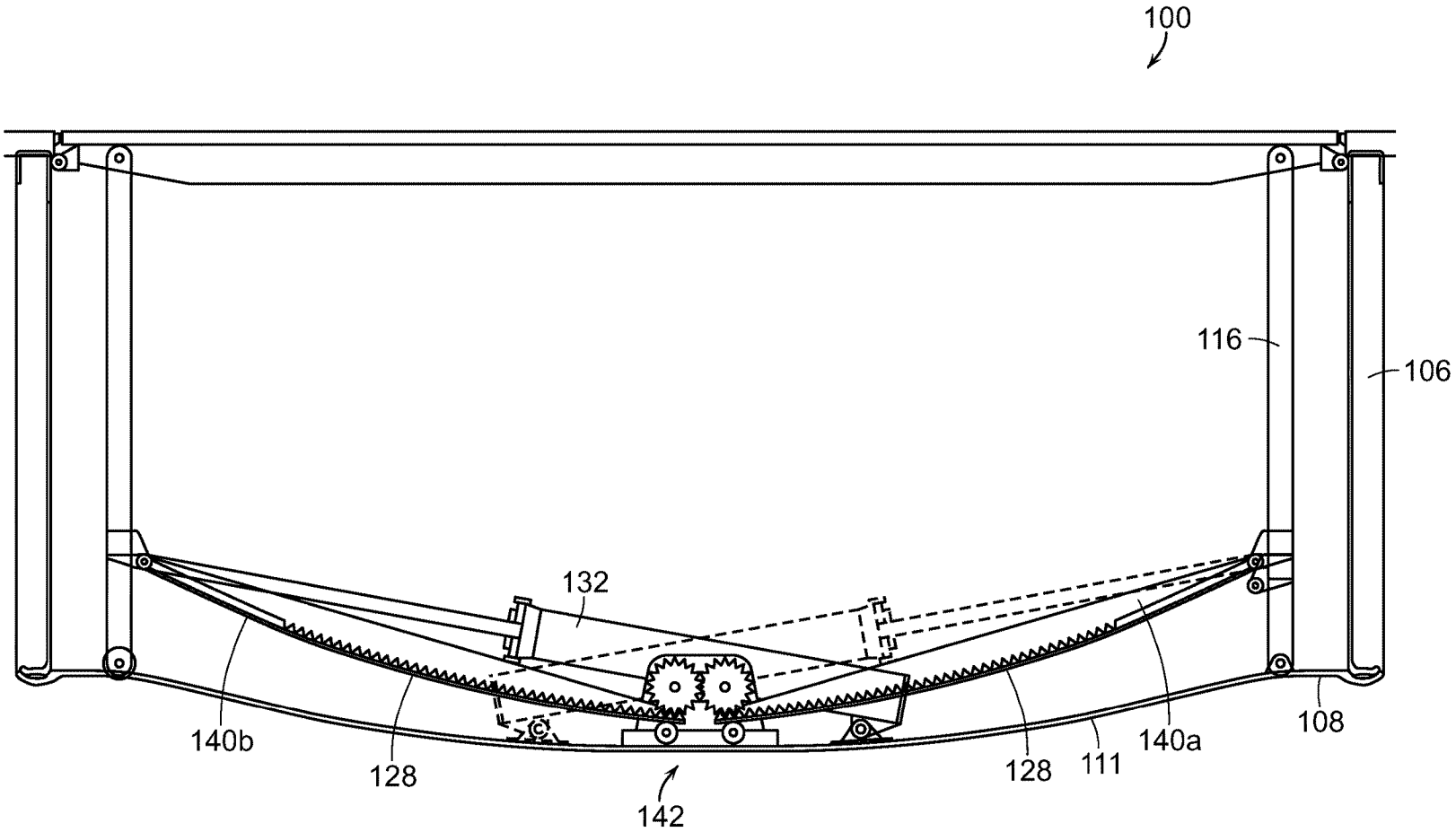
FIG. 15.3

METHODS AND APPARATUSES FOR A VARIABLE DEPTH SWIMMING POOL/SPA

CROSS-REFERENCE TO RELATED APPLICATIONS

This application is claims the benefit of U.S. Provisional Application No. 61/498,123 filed Jun. 17, 2011, and U.S. Provisional Application No. 61/526,198 filed Aug. 22, 2011, the entirety of each of which is incorporated by reference herein.

BACKGROUND

Field of the Invention

This application relates to the field of swimming pools, hot tubs or spas, and other recreational, exercise and therapeutic water devices.

Description of the Related Art

Swimming has long been used for recreation, for health benefits, and for a variety of other purposes. In more recent times, swimming pools have been created to allow swimming in a controlled environment. A typical swimming pool has walls and a bottom that define a volume in which water is filled. While a swimming pool is useful for holding water for swimming and creating an artificial and relatively safe environment for a swimmer, a typical swimming pool has several disadvantages. These disadvantages include, for example, an open top that allows debris and insects to come into the pool, that allows the possibility of people falling into the pool or people using the pool without the knowledge of the pool owner. Frequently, pools are provided with a pool cover to prevent the accumulation of debris in the pool, and to prevent insects and animals from accessing the pool water. While such pool covers are useful in maintaining the cleanliness of a pool, they provide only minimal safety benefits.

While such a pool cover could be improved by making it rigid so as to prevent a person from falling through the pool cover, such a rigid pool cover would provide several drawbacks including, for example, the difficulties inherent in storing a rigid pool cover when not in use, the difficulties in putting the pool cover on and removing the pool cover, and the cost that would be associated with creating a sufficiently strong rigid pool cover to span a pool. Because of these shortcomings and disadvantages of swimming pools, new technologies are required to increase the usability and safety of swimming pools.

SUMMARY OF THE INVENTION

Some embodiments generally relate to swimming pools, spas, hot tubs, cold baths, therapeutic and training pools, and the like, and apparatuses related to the same. Initially, while the term pool/spa is used throughout herein, it should be understood that the methods and devices described herein can be applied to other types of water bodies, including without limitation, swimming pools, hot tubs, spas, swim spas, ice baths, cold pools, therapeutic and training pools, and other artificial recreation, therapeutic and training water devices.

In some embodiments, for example, the swimming pool/spa can include a bottom, a movable deck, and first and second angularly displaceable pool legs that can, for example, connect the bottom of the swimming pool/spa to the movable deck. In some embodiments, for example, the first and second angularly displaceable pool legs can be angularly displaced from a first vertical position to a second position. In some embodiments, for example, the first vertical position can comprise a substantially vertical position such as, for example, within 15 degrees of vertical, within 10 degrees of vertical, within 5 degrees of vertical, within 1 degree of vertical, within ½ degrees of vertical, or any other intermediate angle relative to vertical. In some embodiments of the swimming pool/spa, the angular displacement of the first and second angularly displaceable pool legs can, for example, correspond to a vertical movement of the movable deck relative to the bottom of the swimming pool/spa.

In some aspects of the swimming pool/spa, the first and second angularly displaceable pool legs can be, for example, an H-member. In some embodiments, the swimming pool/spa can further include, for example, vertical walls cooperating with the bottom of the swimming pool/spa to the final volume. In some embodiments of the swimming pool/spa, for example, the movable deck can seal with the vertical walls of the swimming pool/spa. In some embodiments, for example, the seal between the vertical walls of the swimming pool/spa and the movable deck can be sufficiently tight to prevent debris, animals, insects, children or both parts to access the area between the vertical walls of the swimming pool/spa and the movable deck or between the movable deck and the bottom of the swimming pool/spa. In some embodiments, the swimming pool/spa can further include a first arm connected at a first end to the first angularly displaceable pool leg. In some embodiments, for example, the swimming pool/spa can further include a second arm connected at a second end to the second angularly displaceable pool leg. In some aspects, the first arm and the second arm can be dynamically connected to each other. In some embodiments, for example, this dynamic connection between the first arm and the second arm can be such that a movement of the first arm results in a corresponding movement of the second arm. In some embodiments, for example, the dynamic connection between the first arm and the second arm can be achieved in a variety of ways including, for example, via a gear, via a plurality of gears, via a gear box, or via any other desired feature. In some embodiments, for example, the swimming pool/spa can further include a drive. In some embodiments, for example, the drive can apply a force to the angularly displaceable pool leg. In some embodiments, for example, the drive can apply a force to the second angularly displaceable pool leg. Some embodiments with a swimming pool/spa can include a plurality of drives. In some embodiments, for example, the plurality of drives may apply a force to one or both of the angularly displaceable pool legs.

Some embodiments relate to another version of the swimming pool/spa. In some embodiments, for example, the swimming pool/spa can have a bottom, a movable deck, and flow features. In some embodiments, for example, the movable deck can be vertically displaceable relative to the bottom of the swimming pool/spa. In some embodiments, for example, the flow features can control the flow of water from above the movable deck to between the movable deck and the bottom of the swimming pool/spa. In some embodiments, for example, the flow features are positioned to facilitate the cleaning of the portion of the pool/spa located between the movable deck and the bottom of the swimming pool/spa. In some embodiments, these flow features can be configured to control the flow of water from above the movable deck to between the movable deck and the bottom of the swimming pool/spa when the movable deck is moved from a first vertical position relative to the bottom of the swimming pool/spa to a second vertical position relative to the bottom of the swimming pool/spa.

In some embodiments, for example, the swimming pool/spa can further include a vent and a drain that can be, for example, located at the bottom of the swimming pool/spa. In some embodiments, for example, the vent can cooperate with the flow features to push water towards the drain.

In some embodiments, for example, the swimming pool/spa can further include first and second angularly displaceable pool legs. In some embodiments, for example, each of the angularly displaceable pool legs can be rotatingly connected at a first end to the movable deck and can be, for example, slidingly connected at a second end to the bottom of the swimming pool/spa. In some embodiments, for example, the swimming pool/spa can further include a first arm connected at a first end to the first angularly displaceable pool leg. In some embodiments, for example, the swimming pool/spa can further include a second arm connected at a second end to the second angularly displaceable pool leg. In some embodiments, for example, the swimming pool/spa can further include a drive. In some embodiments, this drive can apply a force to the first angularly displaceable pool leg. In some embodiments, for example, this drive can apply a force to the second angularly displaceable pool leg. In some embodiments, for example, the swimming pool/spa can include a plurality of drives that can, for example, apply a force to one or both of the angularly displaceable legs. In some embodiments, for example, the drive can be a hydraulic cylinder attached to the first angularly displaceable leg. In some embodiments, the drive can be a hydraulic cylinder attached to the second angularly displaceable leg. In some embodiments, for example, the drive can be a first hydraulic cylinder attached to the first angularly displaceable leg, and a second hydraulic cylinder attached to the second angularly displaceable leg.

In some embodiments of the swimming pool/spa, the first arm and the second arm can be dynamically connected. Thus, in some embodiments, the first arm and the second arm can be connected such that a movement of the first arm results in a corresponding movement of the second arm. In some embodiments, the dynamic connection between the first arm and the second arm can synchronize movement of the first and the second angularly displaceable legs.

Some embodiments relate to a method for moving a movable deck of a swimming pool/spa from a first position relative to the bottom of the swimming pool/spa to a second position relative to the bottom of the swimming pool/spa. In some embodiments, for example, this method can include applying a force to a first folding leg and to a second folding leg. In some embodiments, the first and second folding legs each can include, for example, a first end that is rotatingly connected to the movable deck and a second end that is slidingly connected with the bottom of the swimming pool/spa. In some embodiments, for example, the method can further include rotating the first and second folding legs relative to the moveable deck from a first position to a second position. In some embodiments, the method can further include sliding the first and second folding legs from a first position relative to the bottom of the swimming pool/spa to a second position relative to the bottom of the swimming pool/spa. In some embodiments, for example, the rotating of the first and second folding legs relative to the movable deck and the sliding of the first and second folding legs relative to the bottom of the swimming pool/spa can result in a vertical displacement of the moveable deck relative to the bottom of the swimming pool/spa.

In some embodiments, for example, the second ends of the first and second folding legs can, for example, terminate in a first and second track portion that can be, for example, affixed directly and/or indirectly to the bottom of the swimming pool/spa. In some embodiments, for example, the method can further include applying a second force directly to the movable deck. In some embodiments, for example, this second force can be directly applied to the movable deck via a hydraulic assist cylinder lift. In some embodiments, for example, this second force can partially assist in vertically displacing the movable deck relative to the bottom of the swimming pool/spa.

The foregoing is a summary and thus contains, by necessity, simplifications, generalizations, and omissions of detail; consequently, those skilled in the art will appreciate that the summary is illustrative only and is not intended to be in any way limiting. Other aspects, features, and advantages of the devices and/or processes and/or other subject matter described herein will become apparent in the teaching set forth herein. The summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

FIG. 1.1-1.3 depicts one embodiment of a variable depth swimming pool/spa.

FIG. 2.1 shows embodiment of aspects of a variable depth swimming pool or spa, including many of the mechanical parts that drive the systems operation.

FIG. 3.1-3.4 show aspects of some embodiment of a variable depth swimming pool/spa.

FIG. 4.1 is a side view of one embodiment of a variable depth swimming pool/spa in a second, lowered position.

FIG. 4.2 depicts a front and end view of one embodiment of a variable depth swimming pool or spa, in the lowered position, including vertical assist lift cylinder.

FIGS. 4.3-4.4 depict a front and end view of one embodiment of a variable depth swimming pool or spa, in the almost top position, including a vertical assist lift cylinder.

FIGS. 5.1-5.3 are views of one embodiment of a synchronizing drive.

FIGS. 6.1-6.5 show views of one embodiment of a curved rack with gear teeth that will synchronize with a geared drive system.

FIG. 7.1 is a side view of one embodiment of a variable depth swimming pool/spa including a drive.

FIG. 7.2 depicts a front and end view of one embodiment of a variable depth swimming pool or spa, in the partially lowered position.

FIG. 7.3 is a side view of one embodiment of a variable depth swimming pool/spa including synchronizing arms and a synchronizing drive.

FIG. 7.4 depicts a front view and an end view of one embodiment of a variable depth swimming pool or spa, in a fully raised position, including synchronizing arms and a synchronizing drive.

FIG. 7.5 depicts a cut-away view of a synchronizing drive and synchronizing rack location when in use in the top position.

FIGS. 8.1-8.2 depicts a front and end view of one embodiment of a variable depth swimming pool or spa, in the fully raised position, including synchronizing arms and a synchronizing drive, two hydraulic cylinders, wedge shaped blocks, in a flat bottom pool or spa.

FIGS. 8.3-8.4 show a front and end view of one embodiment of a variable depth swimming pool or spa, in the lowered position, including synchronizing aims and a synchronizing drive, two hydraulic cylinders, wedge shaped blocks, in a flat bottom pool or spa.

FIGS. 9.1-9.2 depict a front and end view of one embodiment of a variable depth swimming pool or spa, in the fully raised position, including synchronizing arms and a synchronizing drive, two hydraulic cylinders, with an angled and contoured base pool/spa floor.

FIGS. 10.1-10.1A depict a front and view of one embodiment of a variable depth swimming pool or spa, in the fully raised position, including a synchronizing drive, a left and right hand lead screw synchronizing drive, universal joint and center drive.

FIGS. 10.2-10.2B show perspective views of one embodiment of a variable depth swimming pool or spa, with a lead screw synchronizing drive system.

FIGS. 11.1-11.1B show top views of one embodiment of a variable depth swimming pool or spa, depicting an assembled, five piece walls and floor system, and a zoomed in view of the liquid epoxy fill cavity.

FIGS. 11.2-11.2B show a perspective cut-away view of one embodiment of a variable depth swimming pool or spa, depicting an assembled, five piece wall and floor system, and a sectional zoomed in cut view of the connection from wall to floor and liquid, epoxy fill, cavity.

FIG. 12.1 shows an exploded perspective view of one embodiment of a variable depth swimming pool/spa, with a five piece wall and floor.

FIGS. 12.2-12.3 show a perspective view of one embodiment of a variable depth swimming pool/spa, depicting a five piece wall and floor, with the four walls and floor assembled and a zoomed in view of the assembled corner.

FIGS. 13.1-13.3 show a perspective view, end view and zoomed in view of one embodiment of a variable depth swimming pool/spa, including blocks/cut outs/flange piece/pop outs/molded parts and tubes/slots and cavities directing the suction flow to the drains.

FIGS. 14.1-14.3 show a perspective view, and zoomed in views of one embodiment of a variable depth swimming pool/spa, depicting a cable, pulley and tensioning block.

FIGS. 15.1-15.3 depict different views of a flat-ship modular pool and methods for assembling such a pool.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Embodiments described and disclosed herein relate generally to swimming pools, training pools, therapeutic water devices such as hot tubs, spas, cold and ice baths, etc. and methods and apparatuses related to the same. For example, some embodiments relate generally to mechanisms for covering or sealing one of the above-mentioned water devices. Some embodiments relate generally to variable depth water apparatus, such as pools and spas that include deck or floor that can be adjusted to varying depths, and that can function, if desired as a cover or deck over the pool/spa.

Advantageously, the apparatuses, methods and water devices described herein can provide a number of non-limiting benefits. For example, they can provide one environmental benefits, including, for example, preservation of water by reducing or minimizing water evaporation from the swimming pool/spa; reduction in the use of chemicals and decrease in the need for pest control measures because debris and insects can be more effectively sealed off from the swimming pool/spa such that fewer chemicals and cleanings are required to maintain the swimming pool/spa; reduction in energy usage by providing improved thermal isolation and insulation rom the surroundings so that less energy may be required for temperature control; and other environmental benefits. Further, embodiments having a movable deck or cover located above the water can thereby eliminate or minimize the accessible portion of the swimming pool/spa and provide safety advantages by securely covering the water. Thus, the risk of accidental drowning in the variable depth swimming pool/spa can be minimized when the movable deck is positioned above the water of the swimming pool/spa.

A variable depth swimming pool/spa can be configured to include an accessible portion of the swimming pool/spa whose depth can be varied. In some embodiments, this accessible portion of the variable depth swimming pool/spa can be bounded at its lower edge by a movable deck. In some embodiments, the movable deck can be moved from a first position, also referred to as a fully raised position, in which the movable deck is positioned above the water of the variable depth swimming pool/spa such that there is no accessible portion of the variable depth swimming pool/spa.

In some embodiments, for example, the positioning of the movable deck can be adjusted through the use of a mechanical device and/or mechanical system that connects the movable deck to the bottom of the variable depth swimming pool/spa. Some embodiments herein related to improved apparatuses for varying the position of the movable deck or cover. In some aspects, for example, this mechanical device and/or mechanical system can comprise easily manufactured components that can be used in a wide range of swimming pools/spas. Advantageously, such features capable of widespread application can decrease the cost of manufacturing the variable depth swimming pool/spa. Further, through efficient design of the mechanical components of the variable depth swimming pool/spa and the depth of the required excavation for the variable depth swimming pool/spa can be minimized. The following disclosed devices and features advantageously minimize the cost of manufacturing the variable depth swimming pool/spa as they can be applied to a wide range of pool/spa sizes and as they can be adapted to an even wider range of pool/spa sizes by multiplying the number of components used in the variable depth swimming pool/spa. The following disclosed devices, components and features present further advantages in that they minimize the depth of excavation required to install a variable depth swimming pool/spa.

Some embodiments relate to a variable depth swimming pool/spa. In some embodiments, the variable depth swimming pool/spa can include sides and a bottom that together define a water-holding volume. In some embodiments, the variable depth swimming pool/spa can further include a movable deck that can be moved from a first vertical position to a second vertical position. In some embodiments in which the variable depth swimming pool/spa is located below ground level, the first vertical position of the movable deck can be at ground level and the second vertical position of the movable deck can be below ground level. In some embodiments, for example, the movable deck can be made from a plurality of panels. In some embodiments, for example, these panels can be configured to allow mass manufacturing. These configurations can include, for example, constant dimensions between panels, and other features such as constant positioning of bolts and/or bolt holes.

In some embodiments, the panels can be protected from the sun. This can be accomplished, for example, by providing the panels with a protective surface such as tile, including, for example, porcelain tile. However, past attempts to use tile have failed due to the necessity of cutting the tile. Advantageously, by molding the panels to a specific size, such as, for example, the size of four 18-inch slandered tiles, with a slandered grout joint, the finished panel precisely matches the tile size, and thus eliminates the need for cutting of the tile.

Further advantages can be achieved, by sizing the panels to correspond to the spacing of the beams underlying the panels. In some embodiments, further use of the panels can be achieved by, for example, the creation of inserts that can, for example, produce surface plug-ins that allow for the attachment of new surfaces to the panels, such as, for example, a sports court, putting green, and or any other desired surface. In some embodiments, these plug-in surfaces can be interchangeable, and can be configured for use indoors or outdoors.

In some embodiments, the panels can be molded with features configured to receive a perimeter seal or a slip-in flexible grout seal between panels. In some embodiments, the panel molds can include reinforcement ribs cast in the mold. In some embodiments, the mold may be injected with foam. Advantageously, this can provide, for advantage, insulative benefits, structural strength, in that the foam acts as an I-beam, giving tremendous strength to the panel by adhering the two opposing surfaces and thereby causing them two interact as an I-beam, and the expense and/or complexity of the mold is insignificant as a single mold can be used to produce a large number of panels.

In some embodiments, for example, the movable deck can be moved between a first vertical position and a second vertical position by a mechanical device and/or mechanical system connecting the movable deck with the bottom of the swimming pool/spa. In some embodiments, the features and components of the mechanical device and/or mechanical system connecting the movable deck with the bottom of the swimming can include one or several legs, one or several arms, one or several drives, one or several synchronization drives, and/or any other desired features. In some embodiments, for example, the number of these components can be matched to the desired size and other desired parameters of the swimming pool/spa. Thus, for example, in some embodiments in which a larger swimming pool/spa is desired, the variable depth swimming pool/spa can include more legs, more arms, more drives, more synchronization drives, more panels or more of any other desired component that allows the expansion of the size of the variable depth swimming pool/spa.

Some embodiments relate to a variable depth swimming pool/spa that includes features that facilitate the maintenance of a clean swimming pool/spa environment. In some embodiments, for example, these features can include flow features that can be located, for example, in the movable deck of the swimming pool/spa, in the walls of the swimming pool/spa, in the bottom of the swimming pool/spa, or in any other desired portion or component of the swimming pool/spa. In some embodiments, for example, these flow features can control the flow of water from above the movable deck to between the movable deck and the bottom of the swimming pool/spa. Advantageously, these flow features can, by controlling the flow of water, facilitate in cleaning the swimming pool/spa and particularly can facilitate in cleaning the portion of the swimming pool/spa located between the movable deck and the bottom of the swimming pool/spa. In some aspects, this portion of the swimming pool/spa located between the movable deck and the bottom of the swimming pool/spa can be very difficult to reach, and these flow features can provide significant advantages in creating currents that sweep debris toward drains located at the bottom of the swimming pool/spa and that direct cleansing currents around the portion of the swimming pool/spa between the bottom of the movable deck and the bottom of the swimming pool/spa.

A Variable Depth Swimming Pool/Spa

FIG. 1.1 depicts a perspective view of one embodiment of a variable depth swimming pool/spa 100. The variable depth swimming pool/spa 100 can comprise a variety of shapes and sizes. In some embodiments, for example, the variable depth swimming pool/spa 100 can be rectangular, triangular, circular, ovular, hexagonal, pentagonal, or any other desired shape. In some embodiments, for example, the variable depth swimming pool/spa can be less than 1 foot deep, 3 feet deep, 5 feet deep, 6 feet deep, 10 feet deep, 20 feet deep, or can have any other or intermediate depth. In some embodiments, for example, the variable depth swimming pool/spa can cover an area of 10 square feet, 50 square feet, 100 square feet, 1,000 square feet, 10,000 square feet, 50,000 square feet, 100,000 square feet, 500,000 square feet, 1,000,000 square feet or any other or intermediate area.

The variable depth swimming pool/spa 100 can be made from a variety of materials. In some embodiments, for example, the variable depth swimming pool/spa 100 can comprise a natural material, a manmade material, a synthetic material, a polymer, a composite material, and/or any other desired material. In some embodiments, for example, the variable depth swimming pool/spa 100 can comprise, for example, concrete, tile, mortar, plastic, fiberglass, resin, and/or any other desired material. In some embodiments, for example, the variable depth swimming pool/spa 100 can be made using a variety of techniques. In some embodiments, the variable depth swimming pool/spa 100 can be created at the desired end location of the swimming pool/spa. In some embodiments, for example, the variable depth swimming pool/spa 100 can be created at a location different from the final location of the swimming pool/spa.

As seen in FIG. 1.1, the variable depth swimming pool/spa 100 can comprise a movable deck 102. The movable deck 102 can be, for example, located within the volume defined by the variable depth swimming pool/spa 100. In some vertical positions of the movable deck 102, the movable deck 102 can define an upper boundary of the variable depth swimming pool/spa 100.

The moveable deck 102 can be an insulated, foam-filled, fiberglass box or any other material capable of withstanding pool water and capable of functioning as a patio, floor, driveway, and/or pool-bottom. In some embodiments, the moveable deck 102 can be, for example, multi-dimensional to allow for use in different sized-placement areas, and can be multi-colored based on customer preference. In some embodiments, the moveable deck 102 can be configured to hold a decorative surface such as, for example, tile, stone, or specialized, snap-on flooring such as a sport court or golf turf or decorative surface. In some embodiments, the moveable deck 102 can be scalable using the same size panels having the same bolt configuration by adding another unit row to the length or width.

The movable deck 102 can be configured for vertical displacement within the variable depth swimming pool/spa 100. In some embodiments in which the movable deck 102 is level with the ground surrounding the pool/spa, or as shown in FIG. 1.1, level with a pool coping 126, the movable deck 102 can be used as a ground level surface such as, for example, a deck, a patio, a driveway, a path, or any other ground surface. In some embodiments in which the movable deck 102 is in a vertical position below the ground level or below the pool coping 126, the movable deck 102 can be used as the apparent bottom of the variable depth swimming pool/spa 100. Thus, in such a configuration, the movable deck 102 would define the bottom of the portion of the variable depth swimming pool/spa 100 accessible to a pool/spa user.

In some embodiments, the pool coping 126 can be, for example, in-line with the pool walls 106. In some embodiments, the pool coping 126 can overhang the pool walls 106 by, for example, approximately ⅛th of an inch to 1.5 inches, and in some embodiments, by 0.5 inches. Advantageously, this can facilitate the flow of water around the moveable deck 102 as the moveable deck 102 travels through the water.

The movable deck 102 of the variable depth swimming pool/spa 100 can comprise a variety of sizes and shapes. In some embodiments, for example, the size and shape of the movable deck 102 can match the size and shape of the variable depth swimming pool/spa 100.

The movable deck 102 can comprise a variety of materials. In some embodiments, for example, all or portions of the movable deck 102 can comprise a natural, or a manmade material. In some embodiments, for example, the movable deck 102 can include a polymer, a composite, a metal, or any other desired material.

In some embodiments, and as shown in FIG. 1.1, the movable deck 102 of the variable depth swimming pool/spa 100 can comprise one or several panels 104. In some embodiments, and as shown in FIG. 1.1, the panels 104 can define the uppermost surface of the movable deck 102. In some embodiments, for example, the panels 104 can be configured to be water-resistant to withstand the swimming pool/spa environment, can be configured to survive the external environment, be configured to withstand the loads applied to the movable deck, be designed to be aesthetically pleasing, and be configured to prevent slipping. In some embodiments, for example, the panels 104 can include features to facilitate and/or allow the flow of water from the portion of the variable depth swimming pool/spa 100 above the movable deck 102 to the portion of the variable depth swimming pool/spa 100 below the movable deck 102.

The panels 104 can comprise a variety of shapes and sizes. In some embodiments, for example, the panels 104 can be rectangular shaped, triangular shaped, circular, ovular, hexagonal, pentagonal, regularly shaped, irregularly shaped, or have any other desired shape. In some embodiments, the panels 104 can have a length, a width, and/or a thickness of approximately ¼ inch, ½ inch, 1 inch, 3 inches, 6 inches, 12 inches, 18 inches, 24 inches, 36 inches, 48 inches, 60 inches, 100 inches, 200 inches, 500 inches, or any other or intermediate dimension. In some embodiments, the panels 104 can be identical. Advantageously, the creation of identical panels 104 can facilitate in the rapid manufacture of panels and in the creation of variable depth swimming pools/spas 100 having different dimensions.

The variable depth swimming pool/spa 100 shown in FIG. 1.1 further includes one or several pool walls 106 and a bottom 108. As seen in FIG. 1.1, the one or several pool walls 106 and the bottom 108 cooperate to define a volume to contain the water of the swimming pool/spa. As discussed above in the context of the variable depth swimming pool/spa 100, the pool walls 106 and the bottom 108 can comprise a variety of materials and can comprise a variety of shapes and sizes.

FIGS. 1.2 and 1.3 depict perspective views of two embodiments of a variable depth pool 100. FIG. 2.1 shows an embodiment of aspects of a variable depth swimming pool or spa. The components found in these figures are discussed at other locations throughout the application.

In some embodiments of the variable depth swimming pool/spa 100, the movable deck 102 can be configured to move from a first vertical position relative to the bottom 108 of the variable depth swimming pool/spa 100 to a second vertical position relative to the bottom 108 of the variable depth swimming pool/spa. In some embodiments, this movement of the movable deck 102 can be facilitated by a mechanical device and/or mechanical system connecting the movable deck 102 with other portions or another portion of the variable depth swimming pool/spa 100. In some embodiments, and as depicted in FIG. 3.1, these mechanical devices and/or mechanical systems can connect the movable deck 102 substantially with the bottom 108 of the variable depth swimming pool/spa 100.

As specifically seen in FIG. 3.1, the movable deck 102 can be substantially connected to the bottom 108 of the variable depth swimming pool/spa 100 by, in part, an angled member 110. In some embodiments and as shown in FIG. 3.1, the angled member 110 can be located on the bottom 108 of the variable depth swimming pool/spa 100. In some embodiments, for example, the angled member 110 can be integrally formed into the bottom 108 of the variable depth swimming pool/spa 100. In some other embodiments, for example, the angled member 110 can be integral with one or more of the pool walls 106 and the bottom 108 of the variable depth swimming pool/spa 100.

Advantageously, the angled member 110 can allow the moveable deck 102 to move from its lowest position to its highest position while occupying the least amount of pool/spa space. Further, any debris accumulating near the angled member 110 will fall from the angled member 110, and can be directed towards a suction drain, which can be, for example, located in the center of the bottom 108 of the variable depth swimming pool/spa 100.

In some embodiments, for example, the angled member 110 can provide a surface with which other portions of the mechanical device and/or mechanical system connecting the movable deck 102 with the bottom 108 of the variable depth swimming pool/spa 100 can interact. As specifically seen in FIG. 3.1, this surface can comprise an angled surface 111. As also seen in FIG. 3.1, the angled surface 111 can be angled relative to the bottom 108 of the variable depth swimming pool/spa 100. In some embodiments, for example, the angle between the angled surface 111 and the bottom 108 of the swimming pool/spa can be, for example, between 0 degrees and 45 degrees, between 0 degrees and 30 degrees, between 0 degrees and 25 degrees, between 5 degrees and 15 degrees, approximately 10 degrees and/or any other desired or intermediate angle.

In some embodiments, for example, the angled surface 111 can be flush with the bottom 108 of the variable depth swimming pool/spa 100, can be 30 inches above the bottom 108, 6 inches above the bottom 108, 12 inches above the bottom 108, 18 inches above the bottom 108, 24 inches above the bottom 108, 36 inches above the bottom 108, or offset from the bottom 108 by any other or intermediate distance.

In some embodiments, for example, the angled member 110 can comprise a length of, for example, 1 inch, 3 inches, 6 inches, 12 inches, 3 feet, 6 feet, 9 feet, 12 feet, 24 feet, 36 feet, 50 feet, 100 feet, 1000 feet, and/or any other or intermediate length.

In some embodiments, for example, the angled member 110 can comprise a variety of widths. In some embodiments, for example, the angled member 110 can comprise a width of 1 inch, 3 inches, 6 inches, 12 inches, 3 feet, 10 feet, 25 feet, 50 feet, 100 feet, 1000 feet, or any other desired or intermediate width.

In some embodiments, for example, the angled member 110 can be made from any desired material. The angled member 110 can be, for example, made from a material capable of withstanding the pool/spa environment, and capable of withstanding the loads applied to the angled member 110. In some embodiments, for example, the angled member 110 can comprise a low friction material.

As seen in FIG. 3.1, in some embodiments, for example, a track 112 can be located on the angled surface 111 of the angled member 110. In some embodiments, for example, the track 112 can be configured to facilitate the movement of components of the variable depth swimming pool/spa 100. In some embodiments, for example, the track can be configured to facilitate in retaining components of the variable depth swimming pool/spa 100 through different movements.

In some embodiments, the track 112 can comprise a variety of shapes and sizes, and can be made from a variety of materials. In some embodiments, for example, the track 112 can comprise a U-shaped member, a C-shaped member, an L-shaped member, and/or a member having any other desired shape.

In some embodiments, for example, the track 112 can be made from a variety of materials. In some embodiments, for example, the track 112 can be made from a natural material and/or a synthetic material. In some embodiments, for example, the track materials can be selected to withstand the pool/spa environment and/or to withstand the loads applied to the track 112.

In some embodiments, the variable depth swimming pool/spa 100 can comprise a dimple 114. In some embodiments, and as depicted in FIG. 3.1, the dimple 114 can be located in the angled member 110 and/or located in the track 112. In some embodiments, for example, the dimple 114 can be sized and shaped such that it facilitates in retaining components of the variable depth swimming pool/spa 100 in a first position, in a second position or in any other or intermediate position.

Advantageously, the use of a dimple 114 in the angled member 110 and/or in the track 112 can facilitate in locking the movable deck 102 of the variable depth swimming pool/spa 100 in a desired position. Such locking can increase the safety of the variable depth swimming pool/spa 100 and increase the ability of the movable deck 102 to resist movement from a desired position.

Some embodiments of the variable depth swimming pool/spa 100 can further include a leg 116. In some embodiments, for example, the first end of a leg can be connected to the movable deck 102 and the second end of the leg can contact the angled member 110 of the variable depth swimming pool/spa 100. In some embodiments, for example, the leg 116 can transfer the gravitational forces from the movable deck 102 to the angled member 110 and/or to the bottom 108 of the variable depth swimming pool/spa 100. In some embodiments, for example, the leg 116 can be configured to move from a first position to a second position and/or to a number of intermediate positions to change the position of the movable deck 102 of the variable depth swimming pool/spa 100.

The leg 116 can comprise a variety of shapes and sizes and can be made from a variety of materials. A person of skill in the art will recognize the dimensions of the leg 116, as well as the materials from which the leg 116 is made, can depend on the weight of the movable deck 102, load conditions of the leg 116, and the environment in which the leg 116 operates. In some embodiments, for example, the leg 116 can be made from a natural and/or a manmade material. In some embodiments, for example, the leg 116 can comprise metal such as, for example, steel.

The second end of the leg 116 can, for example, contact the angled member 110 via a sliding member 118. In some embodiments, for example, the sliding member 118 can be located at the second end of the leg 116. In some embodiments, for example, the sliding member 118 can facilitate the sliding movement of the second end of the leg 116 relative to the angled member 110 of the variable depth swimming pool/spa 100. In some embodiments, for example, the sliding member 118 can comprise a wheel, a roller, a ball, a skid plate, and/or any other feature or configuration that allows the sliding movement of the second end of the leg 116 relative to the angled member 110. Advantageously, for example, some embodiments of the sliding member 118 can comprise features and/or be made from a material and/or have geometry to facilitate the sliding movement of the leg 116 relative to the angled member 110.

As seen in FIG. 3.1, the first end of the leg 116 can connect to the movable deck 102. In some embodiments, for example, the connection between the first end of the leg 116 to the movable deck 102 can be configured to allow the angular displacement of the leg 116 relative to the movable deck 102. As specifically seen in FIG. 3.1, the first end of the leg 116 can be connected to the movable deck 102 via a rotating connector 120. In some embodiments, for example, the rotating connector 120 can comprise, for example, a hinge, a pivot, a ball joint, and/or any other joint or connector that allows rotating movement of the leg 116 relative to the movable deck 102.

As specifically seen in FIG. 3.1, in some embodiments, the rotating connector 120 can be affixed to the deck support beam 122 of the movable deck 102. The deck support beam 122 can comprise a variety of shapes and sizes and can be made from a variety of materials. In some embodiments, for example, the deck support beam 122 can comprise a rectangular cross-section, a triangular cross-section, a circular cross-section, an ovular cross-section, a hexagonal cross-section, a pentagonal cross-section, an I-beam shaped cross-section, and/or any other cross-section. In some embodiments, for example, the deck support beam 122 can be made from a variety of materials, including a natural material, a manmade material, a metal, and/or any other desired material.

As also seen in FIG. 3.1, the movable deck 102 can include one or several rollers 124. In some embodiments, the moveable deck 102 can comprise 4, 8, 12, 20, 50, 100, or any other or intermediate number of rollers 124. In some embodiments, and as depicted in FIG. 3.1, the rollers 124 can be positioned to interact with the pool walls 106 of the variable depth swimming pool/spa 100. In some embodiments, for example, in which the bottom 108 of the variable depth swimming pool/spa 100 has substantially the same size as the movable deck 102 of the variable depth swimming pool/spa 100, the rollers 124 can be configured to vertically roll along the pool walls 106.

The rollers 124 can comprise a variety of shapes and sizes, and can be made from a variety of materials. A person of skill in the art will recognize that the shape and size of the rollers, as well as the materials used to create the rollers 124 is predicated on the load conditions that the rollers are exposed to, as well as the environmental conditions found in the variable depth swimming pool/spa 100.

FIG. 3.2 depicts a front view of one embodiment of a variable depth swimming pool/spa 100. The variable depth swimming pool/spa 100 depicted in FIG. 3.2 comprises a movable deck 102, a bottom 108, a left angled member 110*a*, a right angled member 110*b*, a left track 112*a*, a right track 112*b*, a left sliding member 118*a*, a right sliding member 118*b*, a left rotating connector 120*a*, a right rotating connector 120*b*, a deck support beam 122, and a plurality of rollers 124.

FIG. 3.2 further depicts one embodiment of the leg 116. As discussed in relation to FIG. 3.2, a variable depth swimming pool/spa 100 can comprise one or several legs 116. In the specific embodiment depicted in FIG. 3.2, the variable depth swimming pool/spa 100 comprises two legs 116. As seen in FIG. 3.2, the legs 116 can comprise a variety of shapes and sizes. In the specific embodiment depicted in FIG. 3.2, the leg 116 comprises an H-member.

The H-member depicted in FIG. 3.2 comprises a left support member 117*a*, a right support member 117*b*, a lateral support member 128, a first connecting feature 130, and a second connecting feature 132. As specifically depicted in FIG. 3.2, the left support member 117*a* connects at its first end to the left rotating connector 120 and at its second end to the left sliding member 118*a*. As similarly seen in FIG. 3.2, the right support member 117*b* connects at its first end to right rotating member 120*b*, and at its second end to right sliding member 118*b*.

In some embodiments, and as seen in FIG. 3.2, the leg 116 can further comprise a lateral support member 128. In some embodiments, and as depicted in FIG. 3.2, the lateral support member 128 can connect the left support member 117*a* to the right support member 117*b*. In some embodiments, the lateral support member 128 can be welded, bolted, or otherwise attached to the left support member 117*a* and the right support member 117*b*.

In some embodiments, for example, the lateral support member 128 can comprise a variety of shapes and sizes, and can be made from a variety of materials. In some embodiments, the lateral support member 128 can comprise a solid and/or a tubular member extending at a left end from the left support member 117*a* to a right support member 117*b* connected at the right end of the lateral support member 128.

As further depicted in FIG. 3.2, some embodiments of the variable depth swimming pool/spa 100 can comprise a first connecting feature 130 and a second connecting feature 132. In some embodiments, and as depicted in FIG. 3.2, the first connecting feature 130 can be configured to connect a component of the variable depth swimming pool/spa 100 to the leg 116. In some embodiments, and similarly, the second connecting feature 132 can be configured to connect other components of the variable depth swimming pool/spa 100 to the lateral support member 128.

In some embodiments of the first connecting feature 130 and/or the second connecting feature 132 can comprise a variety of shapes and sizes, and can be made from a variety of materials. A person of skill in the art will recognize the size and shape of materials of the first connecting feature 130 and the second connecting feature 132 can be based on the loads that must be withstood by the first connecting feature 130 and/or the second connecting feature 132 and the pool/spa environment in which the first connecting feature 130 and the second connecting feature 132 operate.

FIG. 3.3 depicts a close-up view of some components of one embodiment of a movable deck 102. As seen in FIG. 3.3, the movable deck 102 comprises the deck support beam 122. As further depicted in FIG. 3.3, the roller 124 is connected to the end of the deck support beam 122. As further depicted in FIG. 3.3, the roller 124 contacts the pool wall 106, and can be configured to roll along the pool wall 106.

As further seen in FIG. 3.3, the movable deck 102 comprises a gasket 134. As specifically depicted in FIG. 3.3, the gasket 134 can be, for example, located at an end of the movable deck 102. In some embodiments, for example, the gasket 134 can extend around the entire perimeter of the movable deck 102. In some embodiments, for example, the gasket 134 can be configured to seal the movable deck 102 to the pool coping 126.

The gasket 134 can comprise a variety of shapes and sizes, and can be made from a variety of materials. In some embodiments, for example, the gasket 134 can comprise a natural material, a manmade material, a synthetic material, a composite, a polymer, a metal and/or any other desired material. In the specific embodiment depicted in FIG. 3.3, the gasket 134 can comprise a U-shaped member. In some embodiments, portions of the U-shaped member of the gasket 134 can be configured to interact with portions of the pool coping 126 to seal the gap between the movable deck 102 and the pool coping 126.

In some embodiments of the variable depth swimming pool/spa 100 can include features to move the movable deck 102 from a first vertical position relative to the bottom 108 of the variable depth swimming pool/spa 100 to a second vertical position relative to the bottom 108 of the variable depth swimming pool/spa 100.

FIG. 3.4 shows a zoomed in cross sectional cut views of side adjustable rollers and a flexible perimeter seal. The components found in this figure are discussed at other locations throughout the application.

Referring now specifically to FIG. 7.1, FIG. 7.1 depicts one embodiment of a variable depth swimming pool/spa comprising the movable deck 102 connected to the bottom 108 of the variable depth swimming pool/spa 100 via legs 116. As seen in FIG. 7.1, the legs 116 rotatingly connect at a first end to the rotating connector 122, and slidingly contact the angled member 110 at their second end.

As further seen in FIG. 7.1, in some embodiments of the variable depth swimming pool/spa, the variable depth swimming pool/spa 100 can include a drive member 138. In some embodiments, the drive member 138 can be directly mounted to the bottom 108 of the variable depth swimming pool 100, and in some embodiments, the drive member 138 can be mounted to a base stand 10.5. In some embodiments, and as depicted in FIG. 7.1, the drive member 138 can be connected with one or all of the legs 116. In some embodiments, for example, the drive member 138 can be configured to apply a force to some portion of the legs 116.

The drive member 138 can comprise a variety of shapes and sizes and can be made from a variety of materials. In some embodiments, for example, portions of the drive member 138 are made from natural materials, synthetic materials, polymers, plastics, metals, and/or any other desired material.

The drive member 138 can comprise a variety of drive types. As depicted in FIG. 7.1, in some embodiments, the drive member 138 can comprise a hydraulic cylinder. In other embodiments, for example, the drive member 138 can comprise a turbine, a pump, a motor, an engine, an actuator, and/or any other desired member that can generate a force and apply that force to one or more of the legs 116. In some embodiments, the drive member 138 can comprise a low pressure drive. Specifically, in some embodiments, the low pressure drive can operate at pressures under 20 psi, under 40 psi, under 70 psi, under 100 psi, or at any other or intermediate pressure. Advantageously, the use of a low pressure drive can decrease the cost of the drive system, and decrease the safety risks associated with the drive system.

In some embodiments, the low pressure drive can use, for example, water, such as the pool/spa water, or any other fluid as the working fluid. In some embodiments, the low pressure drive includes, for example, antifreeze and/or other chemicals to protect the operation of the low pressure drive. In some embodiments, the low pressure drive can comprise a recreational vehicle pump configured to generate, approximately 40 psi.

FIG. 7.2 depicts a front view of one embodiment of a variable depth swimming pool/spa 100, in slightly lowered, including synchronizing arms and a synchronizing drive. The features depicted in this figure are described in other portions of the application.

In some embodiments, for example, the connection of the drive member 138 to one or all of the legs 116 can result in a disparity of forces applied to the one or more legs 116. In some embodiments, for example, as depicted in FIG. 7.3, when a single drive member 138 is connected with a single leg 116 in an embodiment having more than a single leg 116, the unequal application of force to the different legs can result in the non-horizontal raising of the movable deck 102. Such non-horizontal raising of the movable deck 102 can unfortunately result in damage to the movable deck 102, can result in the movable deck becoming stuck in some portion of the variable depth swimming pool/spa 100, and can provide a variety of other difficulties. In some embodiments, and as depicted in FIG. 7.3, the disparity of force between the legs 116 can be resolved via, among other things, a synchronizing arm 140. In some embodiments, for example, a synchronizing arm 140 can be connected to one or all of the legs 116. In some embodiments, for example, the synchronizing arm 140 can facilitate in synchronizing the movement of the legs 116 such that the movable deck 102 moves from a first vertical position relative to the bottom 108 of the variable depth swimming pool/spa 100 to the second position relative to the bottom 108 of the variable depth swimming pool/spa 100 without causing damage to the movable deck 102 and/or the pool walls 106, and/or getting stuck within the variable depth swimming pool/spa 100.

As specifically depicted in FIG. 7.3, in one embodiment of the variable depth swimming pool/spa 100, the variable depth swimming pool/spa 100 can comprise a left synchronizing arm 140*a* and a right synchronizing arm 140*b*. In the embodiment depicted in FIG. 7.3, the left synchronizing arm 140*a* is connected at a first end to the left leg 116*a* and at a second end to the synchronizing drive 142. Similarly as depicted in FIG. 7.3, the right synchronizing arm 140*b* is connected at a first end to the right leg 116*b* and at a second end to the synchronizing drive 142. In some embodiments, for example, the synchronizing arms 140 can be configured to synchronize the movement of the legs 116 of the variable depth swimming pool/spa 100. In some embodiments, for example, the synchronizing arms 140 can dynamically connect and thereby dynamically connect the legs 116 such that a movement of one of the legs 116 results in a corresponding movement of another or of all of the other legs 116.

The synchronizing anus 140 can comprise a variety of shapes and sizes and have a variety of dimensions. In some embodiments, for example, the synchronizing arms 140 can comprise a dimension at least equal to the greatest distance of separation between the leg 116 and the synchronizing drive 142. In some embodiments, for example, the synchronizing arms 140 can be straight, curved, or comprise a compound or irregular shape.

In some embodiments, for example, the synchronizing arms 140 can comprise features configured to facilitate interaction with the synchronizing drive 142.

In some embodiments, and as depicted in FIG. 7.3, the synchronizing drive 142 can comprise one or several gears. In some embodiments, the one or several gears of the synchronizing drive 142 can connect the synchronizing arms 140. As specifically depicted in FIG. 7.3, in some embodiments, for example, the synchronizing drive 142 can comprise a first gear 144 and a second gear 146. In some embodiments, for example, one of the first gear 144 and the second gear 146 can connect with the left synchronizing arm 140*a* and/or with the right synchronizing arm 140*b*. In some embodiments, and as depicted in FIG. 7.3, the first gear 144 and/or the second gear 146 can mesh with the synchronizing arm teeth 148 found on each of the synchronizing arms 140. Advantageously, the existence of synchronizing arm teeth 148 on the synchronizing arms 140 can facilitate the interaction between the synchronizing arms 140 and the first gear 144 and the second gear 146 of the synchronizing drive 142.

FIG. 7.4 depicts a front view of one embodiment of a variable depth swimming pool or spa, in slightly lowered, including synchronizing arms and a synchronizing drive. FIG. 7.5 depicts a cut view of a synchronizing drive and synchronizing rack location when in use in the top position. The features depicted in these figures are described in other portions of the application.

FIGS. 5.1 and 5.2 depict perspective views of some embodiments of the synchronizing drive 142. As depicted in FIG. 5.1, the synchronizing drive 142 can comprise the first gear 144 and the second gear 146. As further depicted in FIG. 5.1, the first gear 144 can comprise a first meshing gear 150*a* and a first arm gear 152*a*. As also depicted in FIG. 5.1, the second gear 146 can comprise a second meshing gear 150*b* and a second arm gear 152*b*.

In some embodiments, for example, the first gear 144 and the second gear 146 of the synchronizing gear 142 can be the same size, have the same geometry, and/or the same number of teeth. In some embodiments, these aspects of the first gear 144 and of the second gear 146 can be different. Similarly, in some embodiments, for example, the first meshing gear 150*a* can be the same and/or different size, geometry, materials, and/or number of teeth as the second meshing gear 150*b*. Similarly, in some embodiments, the first arm gear 152*a* can comprise the same and/or different numbers of teeth, geometry, size, materials, and/or any other property as the second arm gear 152*b*.

As further depicted in FIG. 5.1, in some embodiments, for example, the synchronizing drive 142 can comprise a front plate 154, a back plate 156, and a bottom 158. In some embodiments, for example, the front plate 154 and the back plate 156 cooperate to define an area in which the first gear 144 and the second gear 146 are contained. As further seen in FIG. 5.1, in some embodiments, for example, the bottom 158 of the synchronizing drive 142 can further define the area containing the first gear 144 and the second gear 146. In some embodiments, for example, the bottom 158 of the synchronizing drive 142 can further facilitate to connect with the front plate 154 and the back plate 156.

A person of skill in the art will recognize that the synchronizing drive 142 can comprise a variety of shapes and sizes and features, and that the synchronizing drive 142 is not limited to the specific embodiment depicted herein.

FIG. 5.2 depicts another view of one embodiment of the synchronizing drive 142. As seen in FIG. 5.2, the synchronizing drive 142 comprises the first gear 144 and the second gear 146. As further seen in FIG. 5.2, the first meshing gear 150*a* of the synchronizing drive 142 meshes with the second meshing gear 152*b* of the synchronizing drive 142. Advantageously, this meshing of the first meshing gear 150*a* and the second meshing gear 150*b* and the connection between the first and second meshing gears 150*a*, 150*b* and the first and second arm gears 152*a*, 152*b* allows the movement of one of the arm gears 152*a*, 152*b* to be transferred via the meshing gears 150*a*, 150*b* to the other of the arm gears 152*a*, 152*b*. Advantageously, this transfer of motion between the meshing gears 150*a*, 150*b* and thereby the arm gears 152*a*, 152*b* results in the transfer of motion between the synchronizing arms 140. This transfer of motion, especially in the case in which the motion is transferred via similarly sized and shaped gears as depicted in FIG. 5.2 can result in the synchronized movement of the synchronizing arms 140 and thereby of the leg 116.

As further depicted in FIG. 5.2, the synchronizing drive 142 can further comprise one or more rollers 160. As specifically depicted in FIG. 5.2, these rollers 160 can be located in the bottom 158 of the synchronizing drive 142. In some embodiments, for example, the distance between the rollers 160 and the first gear 144 and/or the second gear 146 defines a space through which the synchronizing arms 140 can be fed to allow the interaction of the synchronizing arm teeth 148 of the synchronizing arms 140 with the teeth of the first gear 144 and/or the second gear 146. Advantageously, the use of rollers 160 can facilitate in the transfer of movement between the arms 140, and in the function of the synchronizing drive 142.

FIG. 5.3 is a depiction of an exploded view of one embodiment of the synchronization drive 142. The components found in this figure are discussed at other locations throughout the application.

FIGS. 6.1-6.5 depict different embodiments of synchronizing arms 140. In some embodiments, the synchronizing arms 140 are linear, slotted, interlinked, horizontally moving, synchronous, lightly-curved racks. In some embodiments, for example, the purpose of the racks is to provide identical movement in opposing directions to extend and retract the synchronizing arms 140.

In some embodiments, the synchronizing arms 140 can comprise, for example, a jet-cut ribbon of stainless steel gear teeth cut from a large sheet of stainless steel plate. The bottom cut produced by the initial cut is the second set of gear teeth. In some embodiments, the synchronizing arm teeth 148 can be formed on the synchronizing arm by, for example, pushing a flat piece of stainless steel bar through a set of gears powered by a motor. This will allow for very easily produced inexpensive gear-toothed rack.

FIG. 4.1 depicts one embodiment of a variable depth swimming pool/spa 100. As depicted in FIG. 4.1, the variable depth swimming pool/spa 100 is located in a second vertical position relative to the bottom 108 of the variable depth swimming pool/spa 100. As further seen in FIG. 4.1, this second position is characterized in that the angular positioning of the legs 116 relative to the movable deck 102 has changed such that the angle between the legs 116 and the movable deck 102 has decreased. As further seen in FIG. 4.1, this change in the angular positioning of the legs 116 relative to the movable deck 102 has resulted in a change in the relative position of the sliding member 118 of the legs 116 relative to the angled member 110 of the variable depth swimming pool/spa 100. As also seen in FIG. 4.1, the combination of this change in the position of the sliding member 118 relative to the angled member 110 and the change in the angular positioning of the leg 116 relative to the movable deck 102 results in the vertical displacement of the movable deck 102 relative to the bottom 108 such that the movable deck 102 is in close proximity to the bottom 108. This change in the positioning of the legs 116 also results in the change of the relative positioning of the legs 116 to the track 112. In contrast to the positioning of the legs 116 relative to the track 112 shown in FIG. 2, in which the leg 116 extended vertically up from the track 112, the leg 116 shown in FIG. 4.1 is lying in, and/or parallel to the track 112. A person of skill in the art will recognize that while only a finite number of positions of the movable deck 102 relative to the bottom 108 have been depicted in the figures herein, a variable depth swimming pool/spa 100 incorporating the features disclosed herein could be moved through an infinite number of vertical positions of the movable deck 102 relative to the bottom 108 of the variable depth swimming pool/spa 100 and that the present disclosure is not limited to the specific embodiments, and/or the specific vertical positions of the legs 116 and/or the movable deck 102 shown herein.

As also seen in FIG. 4.1, some embodiments of the variable depth swimming pool/spa 100 can comprise, for example, a hydraulic assist cylinder lift 164. In some embodiments, and as shown in FIG. 4.1, the hydraulic assist cylinder lift 164 can be located on the bottom 108 of the variable depth swimming pool/spa 100. In some embodiments, for example, a portion of the hydraulic assist cylinder lift 164 can extend towards, and can in some vertical positions of the movable deck 102, relative to the bottom 108, contact a portion of the movable deck 102. In some embodiments, advantageously, the hydraulic assist cylinder lift 164 can be configured to apply a force to the movable deck 102 when the movable deck 102 is within a range of predetermined vertical positions relative to the bottom 108 of the variable depth swimming pool/spa 100. Advantageously, the application of such a force to the movable deck 102 can facilitate in moving the movable deck 102 from a second position relative to the bottom 108 of the variable depth swimming pool/spa 100 to a first position relative to the bottom 108 of the variable depth swimming pool/spa 100.

The hydraulic assist cylinder lift 164 can comprise a variety of shapes and sizes, and can be made from a variety of materials. A person of skill in the art will recognize that the hydraulic assist cylinder lift 164 is not limited to any specific sizes, shapes, materials, manufacturers, and/or other limitation. A person of skill in the art will further recognize that the hydraulic assist cylinder lift 164 can be sized and shaped to meet the design requirements of any desired pool system.

FIG. 4.2 depicts a front and end view of one embodiment of a variable depth swimming pool or spa, in the lowered position, including vertical assist lift cylinder, and FIGS. 4.3-4.4 depict a front and end view of one embodiment of a variable depth swimming pool or spa, in the almost top position, including a vertical assist lift cylinder. FIGS. 8.1-8.2 depict a front and end view of one embodiment of a variable depth swimming pool or spa, in the top position, including synchronizing arms and a synchronizing drive, two hydraulic cylinders, wedge shaped blocks, in a flat bottom pool or spa. FIGS. 8.3-8.4 depict a front and end view of one embodiment of a variable depth swimming pool or spa, in the lowered position, including synchronizing arms and a synchronizing drive, two hydraulic cylinders, wedge shaped blocks, in a flat bottom pool or spa. FIGS. 9.1-9.2 depict a front and end view of one embodiment of a variable depth swimming pool or spa, in the top position, including synchronizing arms and a synchronizing drive, two hydraulic cylinders, with an angled and contoured base pool/spa floor. FIGS. 10.1-10.1A depict a front and view of one embodiment of a variable depth swimming pool or spa, in the top position, including a synchronizing drive, a left and right hand lead screw synchronizing drive, universal joint and center drive. FIGS. 10.2-10.2B show perspective views of one embodiment of a variable depth swimming pool or spa, with a lead screw synchronizing drive system. FIG. 10.2B depicts a mechanical drive source 130.3 configured to rotate the drive shaft, and two universal joints, one connected to the right hand lead screw one connected to the left hand lead screw. Both of these are connected to the drive shaft. The other features depicted in these figures are described in other portions of the application.

FIGS. 11.1-11.2B show top views of one embodiment of a variable depth swimming pool or spa, depicting an assembled, five piece walls and floor system, and a zoomed in view of the liquid epoxy fill cavity. FIG. 11.1 specifically depicts, a five-section pool 102.1 comprising two side walls 101.2, two short end walls 101.3, and bottom suction drains 103.1. FIG. 11.1B further depicts bolts 108.1 that can be installed, for example, during the installation phase. As also depicted, the angular, contoured bottom 102.1 of the pool that can be constructed or molded out of fiberglass, or shaped by a pool builder using standard pool building materials like gunnite, and the angle 102.2 of the contour, which can be from one to thirty degrees, from two degrees to twenty five degrees, from 5 degrees to 15 degrees, or approximately ten degrees. In some embodiments, the contour can be configured to allow mounting of tracks, and can allow the builder to minimize the amount of excavation required while still maintaining the same depth of platform travel. As further depicted, an opening 105.1 can be located in the bottom and sidewalls. This opening 105.1 can be filled with epoxy or similar bonding liquid. This benefit is the continuous, unobstructed flow of epoxy or liquid creates a very-strong and unique bonding system. These figures further depict bolts 108.1 that can be installed in the pool. The other features depicted in these figures are described in other portions of the application.

FIG. 12.1 show an exploded perspective view of one embodiment of a variable depth swimming pool or spa, depicting a five piece wall, floor and connecting screws. FIGS. 12.2-12.3 show a perspective view of one embodiment of a variable depth swimming pool or spa, depicting a five piece wall and floor, with the four walls and floor assembled and a zoomed in view of the assembled corner. The features depicted in these figures are described in other portions of the application.

FIGS. 13.1-13.3 show a perspective view, end view and zoomed in of one embodiment of a variable depth swimming pool or spa, flange piece 150.1 and tubes 150.3 directing the suction flow to the drains 150.2. When the moveable deck 102 is lowered to its lowest position it shuts off the flow of water from the main pump to the bottom drain 150.2 and filter. When it comes in close contact (limiting the amount of space or flow) or resides on a block or pop-out or cut-out or molded part it then allows the suction from the main drain 150.2 in the bottom center of the pool to redirect the flow of water. Advantageously, this allows the redirecting, via hoses 150.3 or slots/cavities 150.4, removal of sediments via vacuum action from the existing pool pump. The functionality is of great value and is only possible due to the unique design of this pool; because the volume of water is reduced when the platform is in its lowest position we can utilize the flow around the platform to remove sediment that can typically build-up. This is a common problem in all pools which can be eliminated in this design. These figures further depict a standard main-pool drain 150.2 that provides suction to filter, and tubes, hoses 150.3, or slots/cavities 150.4 that allow water flow to be directed. The features depicted in these figures are described in other portions of the application.

FIG. 14.1-14.3 show a perspective view, and zoomed in views of one embodiment of a variable depth swimming pool or spa, depicting a cable, pulley and tensioning block. FIGS. 14.1-14.3 contain an embodiment similar to the embodiment depicted in FIG. 2.1. In contrast to the embodiment of FIG. 2.1, the embodiment of FIGS. 14.1-14.3 comprises an additional stainless-steel or other material based, fixed, specific-shaped block that functions as an anchor, and comprises a recessed dimple that attaches to a constant-length cable that is fixed to the cross bar of the H-member. This cable maintains its tension through the descent of the moveable deck and causes the cylinders to transmit power directly through the water as the descending platform acts as a "parachute". The cable is shaped to maintain its tension and to pick-up any cable slack. These figures further depict the cross bar 20.2 that connects two of the support legs and can be welded or bolted or otherwise-attached via pivot and connects four legs to become the H-member. These figures further depict a pulley assembly 140.3 that is fixed to the bottom of the pool and allows the cable to rotate around it in a fixed location. In some embodiments, the pulley assembly can be spring-loaded or hydraulically assisted. These figures further depict a block 140.2 that the cable wraps around and that can comprise any shape that allows the cable to maintain its tension as the platform descends and the legs fold inward. These figures further depict a stainless-steel cable 140.1 that attaches to the H-member and to the supporting block 140.2. The other features depicted in these figures are described in other portions of the application.

FIGS. 15.1-15.3 depict different views of a flat-ship modular pool and methods for assembling such a pool. A modular flat-ship pool can include panels that, when assembled, create a sealed swimming pool, reservoir or vessel of water or liquid. Some aspects of a flat-ship pool can include a method of joining multiple panels of fiberglass or fiberglass-type material in order to make a completely sealed vessel capable of holding water, other liquid or sewage material. In some embodiments, the method can include joining five or more panels. In some embodiments, the assembled flat-ship pool can include one bottom panel and four side panels with optional sealed lid.

In some embodiments, a flat-ship pool can provide advantages, including, for example, that unit components stack flat for efficient, cost effective shipping and that the panels are easily mass produced. In some embodiments, flat-ship pools can be used to form, a swimming pool, a spa, a water receptacle, a liquid container, a pond, a sewage container, an in-ground container, an above-ground container, and/or a variety of other containers.

A flat-ship pool can facilitate mass-production as the components can be interchangeable. The flat-ship pool can facilitate installation as a flat-ship pool does not require craning for the installation, but can rather be truck delivered and installed piece by piece. Because of the ease of installation, no destructive measures are required (removal of fences, landscaping, etc.), and assembly does not require special skills or tools and takes only hours to complete. Advantageously, the use of the techniques disclosed herein can create connections between the panels that result in a stronger completed pool than current pre-formed fiberglass designs. This is accomplished as, after assembly, the connections function as reinforcement beams, both at the seams and running vertically and horizontally along the sides and bottom of the vessel.

In some embodiments, as seen in FIGS. 15.1 and 15.2, the sealing epoxy 30.1 and 30.1*b* can be, for example, substituted with a non-permanent rubberized material. The vessels can then, for example, have value to end users that require temporary fluid storage, such as, for example, the military, construction companies, mining operations, or similar operations. In such an embodiment, when the vessel is no longer needed, the unit can be dis-assembled and reused. In some embodiments, the wall or floor pieces can be molded into any contour for any shaped end-product. For example, curved shaped pieces can be connected together to form a circular vessel. Likewise, a convex bottom can be substituted for a flat bottom piece to allow for above-ground use. In some embodiments, the flat-ship pool can be used in conjunction with the a moveable deck 102 as discussed above. In such an embodiment, the walls of the flat-ship pool can be vertical. The use of flat-ship pools provides further advantages of current pre-formed fiberglass, in that such pre-formed fiberglass pools cannot be stacked if the walls are vertical, making transportation very expensive and inefficient. Vertical walls are also very problematic to build using pre-formed fiberglass methods due to the master molds and properties required to release the final product from the mold.

In some embodiments of a flat-ship pool, the bottom shape can be configured to optimize the performance of raising and lowering the moveable deck 102.

FIG. 15.1 depicts the connection of two panels using specific panel shaping, parts and seals. FIG. 15.2 depicts how two panels are connected with specific panel shaping, reinforcements, parts and seals. The connectors are shaped differently to efficient use of space. FIG. 15.3 demonstrates how the use of a flat-ship pool in connection with the variable depth pool 100 discussed above. Extension pieces can be used to create unlimited size possibilities, the sealed top is key to temporary and permanent solutions of liquid storage. Temporary or permanent reservoir. Note coping, or edge piece, installs directly to side panel.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A swimming pool/spa comprising:

a bottom;

a moveable deck;

two or more angled surfaces, wherein each angled surface has a high end and a low end;

one or more dimples formed into each of the high ends of the angled surfaces; and first and second angularly displaceable legs connecting the bottom of the swimming pool/spa to the moveable deck;

wherein the first and second angularly displaceable legs can be angularly displaced from a first vertical position, in which the first and second angularly displaced legs form ninety degree angles with the moveable deck and rest in the dimples formed in the high ends of the angled surfaces so as to be secured in the first vertical position, to a second position, wherein the angular displacement of the first and second angularly displaceable legs corresponds to a vertical movement of the moveable deck relative to the bottom.

2. The swimming pool/spa of claim 1, wherein the first and second angularly displaceable legs comprise an H-member.

3. The swimming pool/spa of claim 1, further comprising a drive configured to apply a force to the first angularly displaceable leg.

4. The swimming pool/spa of claim 1, wherein the angled surfaces are disposed on two or more angled members associated with the bottom of the pool/spa.

5. The swimming pool/spa of claim 1, wherein the angled surfaces are integrally formed into the bottom of the pool/spa.

6. The swimming pool/spa of claim 1, wherein a plurality of dimples are formed in each of the angled surfaces, wherein the first and second angularly displaceable legs may be displaced to rest in any one of the plurality of dimples so as to secure the moveable deck in a number of corresponding vertical positions.

7. The swimming pool/spa of claim 1, further comprising vertical walls cooperating with the bottom of the swimming pool/spa to define a volume.

8. The swimming pool/spa of claim 7, wherein the moveable deck is configured to seal with the vertical walls of the swimming pool/spa.

9. The swimming pool/spa of claim 1, wherein the swimming pool/spa further comprises a pool coping.

10. The swimming pool/spa of claim 9, further comprising a U-shaped gasket, wherein the U-shaped gasket extends around the entire perimeter of the moveable deck or the pool coping, such that the moveable deck and the pool coping are configured to form a seal when the moveable deck is raised to its highest vertical position.

11. The swimming pool/spa of claim 1, further comprising a first arm connected at a first end to the first angularly displaceable leg and a second arm connected at a second end to the second angularly displaceable leg.

12. The swimming pool/spa of claim 11, wherein the first arm and the second arm are dynamically connected.

13. The swimming pool/spa of claim 12, wherein the first arm and the second arm are dynamically connected via a gear.

14. A moveable deck configured for use with a swimming pool, spa or other water apparatus, comprising:

a moveable deck;

a plurality of angled members each having a high end and a low end, wherein the angled members attach to a bottom surface of the swimming pool, spa or other water apparatus;

one or more dimples formed into the high ends of the angled members;

a plurality of tracks associated with each of the plurality of angled members;

first and second angularly displaceable legs connecting the moveable deck to the bottom of a swimming pool, spa or other water apparatus; wherein the angularly displaceable legs are rotatably attachable to the moveable deck and slidingly attachable to the tracks of the angled members; wherein the first and second angularly displaceable legs can be angularly displaced from a first vertical position, in which the first and second angularly displaceable legs form ninety degree angles with the moveable deck and rest in the dimples of the angled members, to a second position, wherein the angular displacement of the first and second angularly displaceable legs corresponds to a vertical movement of the moveable deck relative to the bottom of the pool, spa or other water apparatus;

first and second arms, wherein the first arm is connected at a first end to the first angularly displaceable leg and the second arm is connected at a second end to the second angularly displaceable leg, wherein the first arm and the second arm are dynamically connected to synchronize movement of the first and second angularly displaceable legs; and a drive configured to apply a force to the first and second angularly displaceable legs.

15. The movable deck of claim 14, wherein the drive comprises a first hydraulic cylinder attached to the first angularly displaceable leg and a second hydraulic cylinder attached to the second angularly displaceable leg.

16. The movable deck of claim 14, wherein the movable deck comprises a plurality of panels.

17. The movable deck of claim 16, wherein the panels are configured with a plurality of surface plug-ins that allows for attachment of a new surface to the panels.

18. The movable deck of claim 16, wherein a perimeter seal may be attached to the panels.

19. The moveable deck of claim 16, wherein a flexible grout seal may be removably placed between the panels.

20. A method of moving a moveable deck of a swimming pool/spa from a first position relative to the bottom of the swimming pool/spa to a second position relative to the bottom of the swimming pool/spa, the method comprising:

applying a force to a first folding leg and to a second folding leg, wherein the first and second folding legs each comprise a first end rotatingly connected to the moveable deck and a second end slidingly connected with the bottom of the swimming pool/spa;

rotating the first and second folding legs relative to the moveable deck from a first position, in which the legs are vertical so as to form a ninety degree angle with the movable deck, to a second position; and sliding the first and second folding legs down an angled surface from a first position relative to the bottom of the swimming pool/spa to a second position relative to the bottom of the swimming pool/spa, wherein the rotating of the first and second folding legs relative to the moveable deck and the sliding of the first and second folding legs relative to the bottom of the swimming pool/spa vertically displaces the moveable deck relative to the bottom of the swimming pool/spa.

21. The method of claim 20, wherein the second ends of the first and second folding legs terminate in a first and second track portion affixed to the bottom of the swimming pool/spa.

22. The method of claim 20, further comprising applying a second force directly to moveable deck.

23. The method of claim 22, wherein the second force partially assists in vertically displacing the moveable deck relative to the bottom of the swimming pool/spa.

* * * * *